US011492566B2

(12) United States Patent
Breakspear et al.

(10) Patent No.: US 11,492,566 B2
(45) **Date of Patent: *Nov. 8, 2022**

(54) ETHER-BASED LUBRICANT COMPOSITIONS, METHODS AND USES

(71) Applicant: CASTROL LIMITED, Reading (GB)

(72) Inventors: Angela Breakspear, Reading (GB); Gordon David Lamb, Reading (GB); John Michael Redshaw, Reading (GB); Kevin Richard West, Reading (GB); Rebecca Frances Jennings, Reading (GB)

(73) Assignee: Castrol Limited, Reading (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/470,245

(22) PCT Filed: Dec. 14, 2017

(86) PCT No.: PCT/EP2017/082929

§ 371 (c)(1),
(2) Date: Jun. 17, 2019

(87) PCT Pub. No.: WO2018/109128

PCT Pub. Date: Jun. 21, 2018

(65) Prior Publication Data

US 2020/0102521 A1 Apr. 2, 2020

(30) Foreign Application Priority Data

Dec. 16, 2016 (WO) ..... PCT/CN2016/110350

(51) Int. Cl.
*C10M 105/18* (2006.01)
*C10M 129/10* (2006.01)
(Continued)

(52) U.S. Cl.
CPC ..... *C10M 105/18* (2013.01); *C10M 129/10* (2013.01); *C10M 133/12* (2013.01);
(Continued)

(58) Field of Classification Search
CPC ..... C10M 105/18; C10M 169/00; C10M 2207/0406; C10M 2203/003;
(Continued)

(56) References Cited

U.S. PATENT DOCUMENTS 5,503,760 A 4/1996 Bongardt et al.
7,622,431 B2 11/2009 Muir
(Continued)

FOREIGN PATENT DOCUMENTS

CN 101006164 A 7/2007
CN 103361150 A 10/2013
(Continued)

OTHER PUBLICATIONS

International Search Report and the Written Opinion of the International Searching Authority, PCT/EP2017/082929, dated Feb. 9, 2018.
(Continued)

*Primary Examiner* — Vishal V Vasisth
(74) *Attorney, Agent, or Firm* — McDonnell, Boehnen, Hulbert & Berghoff LLP

(57) ABSTRACT

The present invention provides a lubricant composition comprising a base oil of lubricating viscosity, wherein the base oil comprises an ether base stock of formula (A), where: $R_a$ and $R_b$ are aliphatic hydrocarbyl groups and may be the same or different; the lubricant composition further comprising at least one aminic anti-oxidant and at least one phenolic anti-oxidant. In some embodiments, the ether base stock has the formula (1), where: $R_1$ $R_2$, $R_3$, $R_4$, $R_5$ and $R_6$
(Continued)

are as defined herein. The lubricant composition may be used for lubricating a surface in an internal combustion engine as well as for improving the fuel economy performance and/or piston cleanliness performance of an engine and/or a vehicle, such as an automotive vehicle associated with an internal combustion engine.

(A)

(1)

21 Claims, 1 Drawing Sheet

(51) Int. Cl.

| | |
|---|---|
| ***C10M 133/12*** | (2006.01) |
| *C10N 30/02* | (2006.01) |
| *C10N 30/04* | (2006.01) |
| *C10N 30/10* | (2006.01) |
| *C10N 30/00* | (2006.01) |
| *C10N 40/25* | (2006.01) |

(52) U.S. Cl.
CPC ..... *C10M 2207/023* (2013.01); *C10M 2207/0406* (2013.01); *C10M 2215/065* (2013.01); *C10M 2215/067* (2013.01); *C10N 2030/02* (2013.01); *C10N 2030/04* (2013.01); *C10N 2030/10* (2013.01); *C10N 2030/52* (2020.05); *C10N 2030/54* (2020.05); *C10N 2030/74* (2020.05); *C10N 2040/25* (2013.01)

(58) Field of Classification Search
CPC ..... C10N 2040/25; C10N 2030/10; C10N 2030/04; C10N 2030/54
See application file for complete search history.

(56) References Cited

U.S. PATENT DOCUMENTS

| | | | | |
|---|---|---|---|---|
| 8,293,693 | B2 | 10/2012 | Kamimura et al. | |
| 9,365,789 | B2 | 6/2016 | Yoshida et al. | |
| 9,719,045 | B2 | 8/2017 | Aida et al. | |
| 2005/0198894 | A1 | 9/2005 | Midgal et al. | |
| 2006/0045397 | A1 | 3/2006 | Hirata et al. | |
| 2006/0090393 | A1 | 5/2006 | Rowland et al. | |
| 2007/0225180 | A1* | 9/2007 | Tamoto | C10M 105/18 508/362 |
| 2007/0281873 | A1 | 12/2007 | Okada | |
| 2009/0270295 | A1 | 10/2009 | Kaneko | |
| 2014/0256607 | A1* | 9/2014 | Tamoto | C10M 107/00 508/494 |
| 2016/0137945 | A1 | 5/2016 | Carrera et al. | |
| 2017/0183598 | A1 | 6/2017 | Maruyama | |

FOREIGN PATENT DOCUMENTS

| | | | |
|---|---|---|---|
| CN | 104769086 | A | 10/2013 |
| CN | 105238521 | A | 1/2016 |
| CN | 105567385 | A | 5/2016 |
| CN | 105567402 | A | 5/2016 |
| EP | 1533362 | A1 | 5/2005 |
| EP | 1577371 | A1 | 9/2005 |
| EP | 1752515 | B1 | 9/2015 |
| EP | 3257922 | A1 | 12/2017 |
| GB | 817054 | A | 7/1959 |
| GB | 2355466 | A | 4/2001 |
| JP | S48-039507 | A | 6/1973 |
| JP | S49-012746 | A | 2/1974 |
| JP | H07-505920 | A | 6/1995 |
| JP | 2006-064151 | A | 3/2006 |
| JP | 2007-137953 | A | 6/2007 |
| WO | 9921902 | A1 | 5/1999 |
| WO | 03099890 | A2 | 12/2003 |
| WO | 2004/090082 | A1 | 7/2006 |
| WO | 2006099250 | A1 | 9/2006 |
| WO | 2016129148 | A1 | 8/2016 |
| WO | 2016203310 | A1 | 12/2016 |
| WO | 2014/104174 | A1 | 1/2017 |

OTHER PUBLICATIONS

The International Search Report, PCT/CN2016/110350, 5 pages, dated Aug. 18, 2017.

* cited by examiner

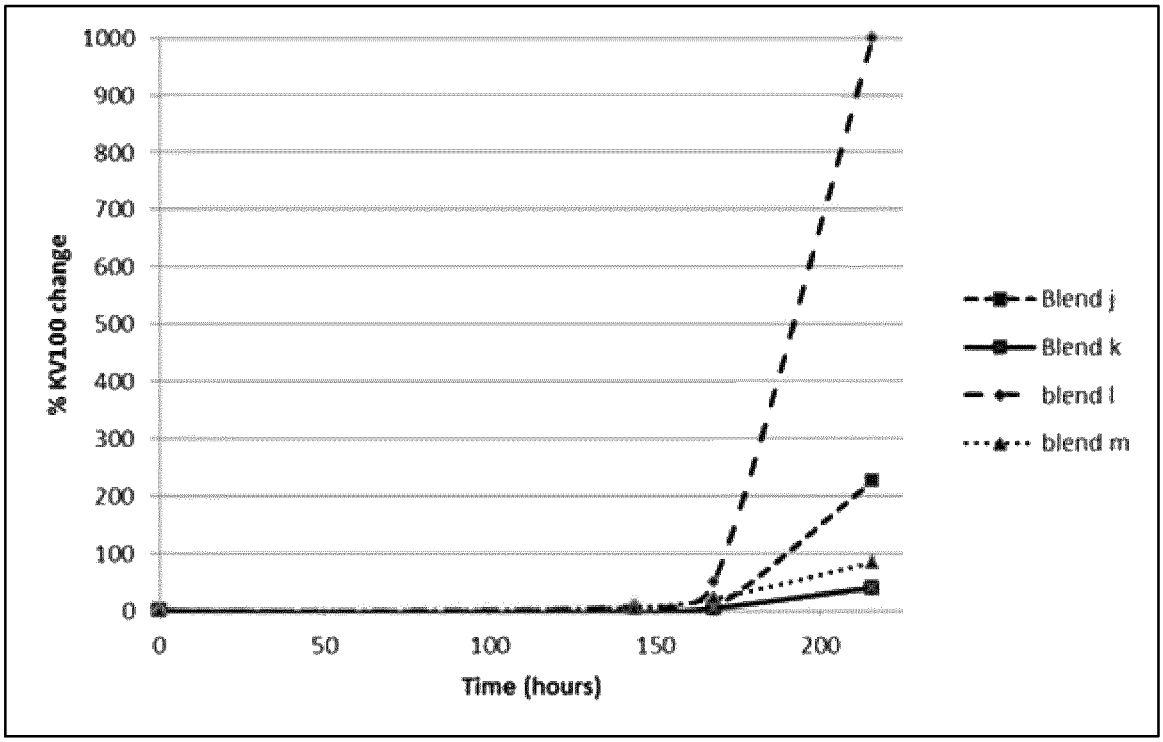
1000
900
800
700
600
500
400
300
200
100
0
% KV100 change
0
50
100
150
200
Time (hours)
Blend j
Blend k
blend l
blend m

ETHER-BASED LUBRICANT COMPOSITIONS, METHODS AND USES

This application is a national stage application under 35 U.S.C. § 371 of International Application No. PCT/EP2017/082929, filed Dec. 14, 2017, which claims priority to International Application No. PCT/CN2016/110350, filed Dec. 16, 2016, the disclosures of which are explicitly incorporated by reference herein.

The present invention relates to lubricant compositions containing base oils comprising certain ether base stock which are suitable for use in a lubricant composition intended for use in an internal combustion engine. Also provided are methods and uses of the lubricant compositions and of the ether base stocks.

BACKGROUND

Lubricating compositions generally comprise a base oil of lubricating viscosity together with one or more additives to deliver properties including for example, reduced friction and wear, improved viscosity index, improved dispersancy, detergency, and resistance to oxidation and corrosion. A lubricant base oil may comprise one or more lubricating base stocks.

Lubricant base stocks used in automotive engine lubricants are generally obtained from petrochemical sources, for example they may be obtained as the higher boiling fractions isolated during the refining of crude oil or as the products of chemical reactions of feedstocks from petrochemical sources. Lubricant base stocks can also be made from Fischer-Tropsch wax.

Lubricant base stocks may be classified as Group I, II, III, IV and V base stocks according to API standard 1509, "ENGINE OIL LICENSING AND CERTIFICATION SYSTEM", 17$^{th}$ Edition, Annex E (October 2013 with Errata March 2015), as set out in Table 1.

TABLE 1

| Group | Saturated hydrocarbon content (% by weight) ASTM D2007 | | Sulphur content (% by weight) ASTM D2622, D4294, D4927, D3120 or D1552 | | Viscosity Index ASTM D2270 |
|---|---|---|---|---|---|
| I | <90 | and/or | >0.03 | and | ≥80 and <120 |
| II | ≥90 | and | ≤0.03 | and | ≥80 and <120 |
| III | ≥90 | and | ≤0.03 | and | ≥120 |
| IV | Polyalphaolefins | | | | |
| V | all base stocks not in Groups I, II, III or IV | | | | |

Group I base stocks are typically manufactured by known processes including, for example, solvent extraction and solvent dewaxing, or solvent extraction and catalytic dewaxing. Group II and Group III base stocks are typically manufactured by known processes including, for example, catalytic hydrogenation and/or catalytic hydrocracking, and catalytic hydroisomerisation. Group IV base stocks include for example, hydrogenated oligomers of alpha olefins.

A combination of properties is desirable in a base stock for conferring to a lubricant composition comprising it. In some instances, for example in passenger car engine oils, it may be desirable for a base stock to confer a low viscosity profile on the lubricant composition, since this leads to improved fuel economy. In particular, it is desirable for base stocks to have a low kinematic viscosity as well as good low-temperature viscosity characteristics, for example a low pour point or low viscosity as measured using a mini-rotary viscometer (MRV). However, the general trend is for an improvement in the viscosity profile (i.e. a reduction in viscosity parameters) of a base oil to be accompanied by an undesirable increase in volatility.

In addition, it is desirable for lubricant compositions to exhibit good oxidation stability, particularly when used in an internal combustion engine where oxidative degradation is exacerbated as a result of the high temperatures encountered in an engine. Good oxidation stability can extend the useful lifetime of a lubricant composition, for instance, by reducing oxidative thickening, which can otherwise rapidly lead to a loss of fuel economy, as well as decreasing deposit and sludge formation which may otherwise ultimately result in engine failure. Typically, oxidation stability of a lubricant composition is improved by the addition of anti-oxidants. An antioxidant level representative of a high performance engine oil may exceed 5%, by weight of the lubricant composition. Thus, a significant proportion of the composition may be made up of anti-oxidants and therefore these represent a significant cost component of the lubricant composition. Common anti-oxidants used in lubricant compositions for use in an internal combustion engine include phenolic and aminic anti-oxidants. However, the presence of phenolic anti-oxidants is known to have detrimental environmental effects whilst the presence of aminic anti-oxidants has been found by the inventors to contribute to turbocharger deposits, piston varnish and copper corrosion and can also cause problems with elastomer compatibility. Negative interactions between a lubricant composition and oil seals that are found in engines may, in some cases, lead to loss of lubricant through failure of the oil seals.

Accordingly, there is a need for a lubricant composition having low volatility for a given viscosity profile, but which is also suitable for use in an internal combustion engine. There is also a need for a lubricant composition which exhibits good oxidative stability without requiring a high anti-oxidant treat rate, as is typically associated with a high performance engine oil.

SUMMARY

Accordingly, in a first aspect a lubricant composition is provided comprising a base oil of lubricating viscosity, wherein the base oil comprises an ether base stock of formula (A):

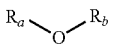

(A)

where:

$R_a$ and $R_b$ are aliphatic hydrocarbyl groups and may be the same or different;

the lubricant composition further comprising at least one aminic anti-oxidant and at least one phenolic anti-oxidant.

In a particularly preferred embodiment, the ether base stock of the lubricant composition is selected from a subset of the compounds of formula (A), namely a compound of formula (1):

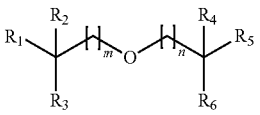

(1)

where:

$R_1$ and $R_2$ are alkyl or, together with the carbon atom to which they are attached, cycloalkyl;

$R_3$, $R_4$ and $R_5$ are H or alkyl;

$R_6$ is alkyl or

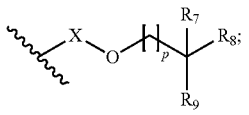

where:

$R_7$ and $R_8$ are H, alkyl or, together with the carbon atom to which they are attached, cycloalkyl;

$R_9$ is H or alkyl;

X is alkylene or is absent; and p is 0, 1, 2 or 3; and m and n are 0, 1, 2 or 3 provided that m is 0 when $R_4$ and $R_5$ are H.

Also provided are methods of preparing lubricant compositions.

Also provided is a method for lubricating a surface using a lubricant composition, as well as the use of a lubricant composition for lubricating a surface.

Also provided are methods and uses of improving the oxidative stability of a lubricant composition, as well as improving the fuel economy performance and/or piston cleanliness performance of an engine and/or a vehicle, such as an automotive vehicle associated with an internal combustion engine.

DETAILED DESCRIPTION

A lubricant composition is provided comprising a base oil of lubricating viscosity, wherein the base oil comprises an ether base stock of formula (A):

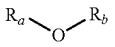

(A)

where:

$R_a$ and $R_b$ are aliphatic hydrocarbyl groups and may be the same or different;

the lubricant composition further comprising at least one aminic anti-oxidant and at least one phenolic anti-oxidant.

For the purposes of the present invention, the following terms as used herein shall, unless otherwise indicated, be understood to have the following meanings:

The term "aliphatic hydrocarbyl" as used herein refers to a group comprising hydrogen and carbon atoms, where one or more carbon atoms may optionally be replaced with —O—, which group may be saturated or unsaturated, preferably saturated, and contains from 1 to 40 carbon atoms. Examples of hydrocarbyl groups include hydrocarbyl groups containing from 2 to 80 carbon atoms, such as from 3 to 26 carbon atoms or from 4 to 24 carbon atoms. Where one or more of the carbon atoms is replaced with —O—, from 2% to 35% of the carbon atoms are preferably replaced with —O—, or from 5% to 25%. In other examples, the aliphatic hydrocarbyl group has 1 to 3 carbon atoms replaced with —O—, for example 2 carbon atoms replaced with —O—. In other examples, none of the carbon atoms are replaced with —O—.

Examples of aliphatic hydrocarbyl groups include acyclic groups, non-aromatic cyclic groups and groups comprising both an acyclic portion and a non-aromatic cyclic portion. The aliphatic hydrocarbyl group may be straight chain or branched chain. The aliphatic hydrocarbyl group includes monovalent groups and polyvalent groups as specified. Examples of monovalent hydrocarbyl groups include alkyl, alkenyl, alkynyl and carbocyclyl (e.g. cycloalkyl or cycloalkenyl).

The term "alkyl" as used herein refers to a monovalent straight or branched chain alkyl moiety containing from 1 to 40 carbon atoms. Examples of alkyl groups include alkyl groups containing from 1 to 30 carbon atoms, e.g. from 2, 3 or 4 carbon atoms to 24, 25, or 26 carbon atoms, e.g. from 1 to 20 carbon atoms, from 1 to 14 carbon atoms, from 2 to 26 carbon atoms and from 3 to 24 carbon atoms. Particular examples include alkyl groups containing 1, 2, 3, 4, 5, 6, 7, 8, 9, 10, 11, 12, 13, 14, 15, 16, 17, 18, 19, 20, 21, 22, 23, 24, 25, 26, 27, 28, 29 and 30 carbon atoms. Examples of alkyl groups include methyl, ethyl, n-propyl, isopropyl, n-butyl, sec-butyl, tert-butyl, pentyl, hexyl and the like. Unless specifically indicated otherwise, the term "alkyl" does not include optional substituents.

The term "cycloalkyl" as used herein refers to a monovalent saturated aliphatic hydrocarbyl moiety containing from 3 to 40 carbon atoms and containing at least one ring, wherein said ring has at least 3 ring carbon atoms. The cycloalkyl groups mentioned herein may optionally have alkyl groups attached thereto. Examples of cycloalkyl groups include cycloalkyl groups containing from 3 to 16 carbon atoms, e.g. from 3 to 10 carbon atoms. Particular examples include cycloalkyl groups containing 3, 4, 5 or 6 ring carbon atoms. Examples of cycloalkyl groups include groups that are monocyclic, polycyclic (e.g. bicyclic) or bridged ring system. Examples of cycloalkyl groups include cyclopropyl, cyclobutyl, cyclopentyl, cyclohexyl and the like.

The term "alkenyl" as used herein refers to a monovalent straight or branched chain alkyl group containing from 2 to 40 carbon atoms and containing, in addition, at least one carbon-carbon double bond, of either E or Z configuration unless specified. Examples of alkenyl groups include alkenyl groups containing from 2 to 28 carbon atoms, e.g. from 3 to 26 carbon atoms, e.g. from 4 to 24 carbon atoms. Particular examples include alkenyl groups containing 2, 3, 4, 5 or 6 carbon atoms. Examples of alkenyl groups include ethenyl, 2-propenyl, 1-butenyl, 2-butenyl, 3-butenyl, 1-pentenyl, 2-pentenyl, 3-pentenyl, 1-hexenyl, 2-hexenyl, 3-hexenyl and the like.

The term "alkylene" refers to a divalent straight or branched chain saturated hydrocarbyl group consisting of hydrogen and carbon atoms and containing from 1 to 30 carbon atoms. Examples of alkylene groups include alkylene groups that contain from 1 to 20 carbon atoms, e.g. from 1 to 12 carbon atoms, e.g. from 1 to 10 carbon atoms. Particular examples include alkylene groups that contain 1, 2, 3, 4, 5 or 6 carbon atoms.

The term "alkoxy" as used herein refers to —O-alkyl, wherein alkyl is as defined herein. In some examples an alkoxy group contains from 1 to 40 carbon atoms, e.g. from 1 to 28 carbon atoms, or from 1 to 26 carbon atoms, or from 1 to 24 carbon atoms e.g. from 1 to 10 carbon atoms. Particular examples include alkoxy groups that contain 1, 2, 3, 4, 5 or 6 carbon atoms. Examples of alkoxy groups include methoxy, ethoxy, propoxy, isopropoxy, butoxy, tert-butoxy, pentoxy, hexoxy and the like.

The terms "alkoxy-substituted-alkyl" and "cycloalkyl-substituted-alkyl" refer to a straight or branched chain alkyl group in which one of the hydrogens of the alkyl chain is replaced with an alkoxy or cycloalkyl group as described herein, respectively.

In some embodiments, at least one of $R_a$ and $R_b$ of formula (A) is alkyl is branched-chain alkyl, alkoxy-substituted-alkyl or cycloalkyl-substituted-alkyl.

In some embodiments, $R_a$ and $R_b$ of formula (A) are independently selected from alkyl, alkoxy-substituted-alkyl and cycloalkyl-substituted-alkyl, provided that where $R_a$ and $R_b$ are both alkyl at least one of $R_a$ and $R_b$ is branched-chain alkyl. In preferred embodiments, when $R_a$ and $R_b$ are both alkyl, both $R_a$ and $R_b$ are branched-chain alkyl.

In some embodiments, $R_a$ and $R_b$ of formula (A) are independently selected from $C_{1-30}$ alkyl, such as $C_{2-20}$ alkyl, $C_{5-30}$ cycloalkyl-substituted-alkyl, such as $C_{5-25}$ cycloalkyl-substituted-alkyl, or $C_{2-30}$ alkoxy-substituted-alkyl, such as $C_{2-20}$ alkoxy-substituted-alkyl.

In some embodiments, $R_a$ of formula (A) contains more carbon atoms than $R_b$.

In some embodiments, $R_a$ of formula (A) contains from 12 to 30 carbon atoms, preferably from 12 to 26 carbon atoms, and/or $R_b$ contains from 2 to 20 carbon atoms, preferably from 2 to 12 carbon atoms.

In particularly preferred embodiments, the ether base stock of the lubricant composition is a compound of formula (1):

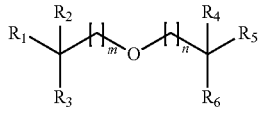

(1)

where:

$R_1$ and $R_2$ are alkyl or, together with the carbon atom to which they are attached, cycloalkyl;

$R_3$, $R_4$ and $R_5$ are H or alkyl;

$R_6$ is alkyl or

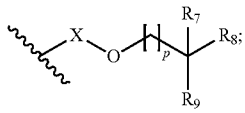

where:

$R_7$ and $R_8$ are H, alkyl or, together with the carbon atom to which they are attached, cycloalkyl;

$R_9$ is H or alkyl;

X is alkylene or is absent; and p is 0, 1, 2 or 3; and m and n are 0, 1, 2 or 3 provided that m is 0 when $R_4$ and $R_5$ are H.

In some embodiments, $R_1$ and $R_2$ are $C_{1-15}$ alkyl or, together with the carbon atom to which they are attached, $C_{5-30}$ cycloalkyl, such as $C_{2-12}$ alkyl or, together with the carbon atom to which they are attached, $C_{5-25}$ cycloalkyl.

In some embodiments, $R_3$, $R_4$ and $R_5$ are H or $C_{1-15}$ alkyl, such as H or $C_{2-12}$ alkyl. Preferably, $R_5$ is H.

In some embodiments, $R_6$ is $C_{1-20}$ alkyl or

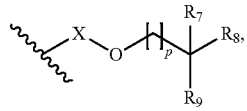

such as $C_{1-16}$ alkyl or

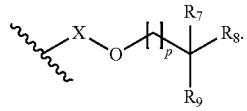

In some embodiments, $R_7$ and $R_8$ are H, $C_{1-20}$ alkyl or, together with the carbon atom to which they are attached, $C_{5-30}$ cycloalkyl, such as H, $C_{2-12}$ alkyl or, together with the carbon atom to which they are attached, $C_{5-25}$ cycloalkyl. Preferably, $R_7$ and $R_8$ are $C_{1-20}$ alkyl, such as $C_{2-12}$ alkyl.

In some embodiments, $R_9$ is H or $C_{1-20}$ alkyl, such as H or $C_{2-12}$ alkyl. Preferably, $R_9$ is H.

In some embodiments, X is $C_{1-20}$ alkylene, such as $C_{3-15}$ alkylene.

In some embodiments, p is 0, 1 or 2, such as 0 or 1.

In some embodiments, m and n are 0, 1 or 2, such as 0 or 1.

$R_1$ and $R_2$ are as described as alkyl or, together with the carbon atom to which they are attached, cycloalkyl. It will be understood that, where $R_1$ and $R_2$ are both alkyl groups, they may be the same as or different from one another. Similar considerations apply to other substituents which are defined as part of a group of substituents. Thus, the considerations apply, for example, to $R_3$, $R_4$ and $R_5$; to $R_7$ and $R_8$; and to the values taken by m and n. For instance, where $R_3$, $R_4$ and $R_5$ are described as being H or alkyl, it will be understood that each of $R_3$, $R_4$ and $R_5$ may be H, each of $R_3$, $R_4$ and $R_5$ may be alkyl, or a subset of $R_3$, $R_4$ and $R_5$ may be H and another subset of $R_3$, $R_4$ and $R_5$ may be alkyl. Where $R_3$, $R_4$ and $R_5$, or a subset thereof, are alkyl, each of $R_3$, $R_4$ and $R_5$ may be the same alkyl group or they may be different alkyl groups. In contrast, where $R_1$ (or any other notation) is used at a number of locations in a formula, it is used to denote the presence of the same group at each of these locations.

In each of the embodiments disclosed herein, the ether compounds of the lubricant compositions may contain a total number of carbons atoms of from about 20 to about 50. For instance, the total number of carbons in the ether compounds may be from about 25 to about 45, such as from about 28 to about 40 or from about 28 to about 36.

As indicated previously, the alkyl and alkylene groups mentioned herein, i.e. those that may be represented by $R_a$, $R_b$, $R_1$, $R_2$, $R_3$, $R_4$, $R_5$, $R_6$, $R_7$, $R_8$, $R_9$ and X, may be straight chain alkyl or alkylene groups, though they may also be branched. In some embodiments, each alkyl group and each alkylene group contains a single branch point or is a straight chain alkyl or alkylene group. For example, when $R_a$ and $R_b$ are both alkyl groups, at least one of these alkyl groups is branched, preferably both. In some embodiments, for instance with respect to $R_1$, $R_2$, $R_3$, $R_4$, $R_5$, $R_6$, $R_7$, $R_8$, $R_9$ and X groups, the alkyl and alkylene groups are straight chain alkyl or alkylene groups. It will be understood that, aside from alkyl branching (if present), the alkyl and alkylene groups are unsubstituted unless otherwise indicated and so may not contain any atoms other than carbon or hydrogen.

The compounds of formula (A) and/or formula (1) may have a kinematic viscosity at 40° C. of less than about 25 cSt, such as less than about 20 cSt, or less than about 17 cSt. The compounds may have a kinematic viscosity at 100° C. of less than about 7 cSt, such as less than about 5 cSt, or less than about 4 cSt. The compounds may have a viscosity index of greater than about 100, such as greater than about 110, or greater than about 120. The kinematic viscosity at 40° C. and the kinematic viscosity at 100° C. may be measured according to ASTM D7279. The viscosity index may be measured according to ASTM D2270.

The compounds may have a Noack volatility of less than about 26%, such as less than about 20%, less than about 16%, or less than about 12% by weight. Noack volatility may be measured according to CEC-L-40-A-93.

The compounds may have a viscosity at 150° C. and a shear rate of $10^6$ $s^{-1}$ of no greater than 1.7 cP, such as no greater than 1.5 cP. This high temperature high shear viscosity may be measured according to CEC-L-36-A-90.

The ether compounds described herein may be used for reducing the total amount of anti-oxidant additive required in a lubricant composition, the anti-oxidant comprising at least one aminic anti-oxidant and at least one phenolic anti-oxidant, in order for the lubricant composition to achieve a particular level of oxidative stability performance, preferably where the lubricant composition is for an internal combustion engine, such as that associated with an automotive vehicle. In preferred embodiments, the lubricant compositions for improving through the use of the ether compounds described herein comprise have a total combined amount of aminic and phenolic anti-oxidant in the lubricant composition of not more than 4.0%, not more than 3.0%, not more than 2.5%, or not more than 2.0%, by weight of the lubricant composition. In preferred embodiments, the lubricant compositions for improving through the use of the ether compounds described herein have a total combined amount of aminic and phenolic anti-oxidant in the lubricant composition of at least 0.25%, at least 0.5%, or at least 1.0%, by weight of the lubricant composition Accordingly, there is also provided a method of reducing the total amount of anti-oxidant additive required in a lubricant composition, the anti-oxidant comprising at least one aminic anti-oxidant and at least one phenolic anti-oxidant, in order for the lubricant composition to achieve a particular level of oxidative stability performance, comprising the step of providing or supplying to the lubricant composition at least one of the ether compounds described herein. In preferred embodiments, the lubricant composition is for an internal combustion engine, such as that associated with an automotive vehicle. In preferred embodiments, the lubricant compositions for improving by means of the ether compounds described herein have a total combined amount of aminic and phenolic anti-oxidant in the lubricant composition of not more than 4.0%, not more than 3.0%, not more than 2.5%, or not more than 2.0%, by weight of the lubricant composition. In preferred embodiments, the lubricant compositions for improving by means of the ether compounds described herein have a total combined amount of aminic and phenolic anti-oxidant in the lubricant composition of at least 0.25%, at least 0.5%, or at least 1.0%, by weight of the lubricant composition.

The lubricant compositions described herein may be used to improve the fuel economy performance and/or piston cleanliness performance of an engine and/or a vehicle, such as an automotive vehicle associated with an internal combustion engine. Accordingly, there is provided a method of improving the fuel economy performance and/or piston cleanliness performance of an engine and/or a vehicle, such as an automotive vehicle associated with an internal combustion engine, comprising the step of providing to the engine and/or the vehicle with a lubricant composition as described herein.

The ether compounds described herein may have a pour point of less than −10° C., such as less than about −25° C., or less than about −35° C. Pour point may be measured according to ASTM D5950.

The ether compounds may have a cold-crankcase simulator viscosity at −35° C. of less than about 1800 cP, such as less than about 1500 cP, or less than about 1200 cP, for example as measured according to ASTM D5293.

The ether compounds may have a DSC oxidation onset temperature of greater than about 165° C., such as greater than about 175° C., or greater than about 185° C., for example as measured according to ASTM E2009 (method B).

In particular embodiments, the ether compounds of formula (A) or formula (1) may have a kinematic viscosity at 100° C. of about 3 to about 4 cSt and a Noack volatility of less than about 20%, such as less than about 16%, or less than about 12%, by weight; or a kinematic viscosity at 100° C. of about 2 to about 3 cSt, and a Noack volatility of less than about 40%, such as less than about 30%, by weight.

The ether compounds of formula (A) or formula (1) are particularly suited for blending into a lubricant composition. In particular, the compounds are miscible with conventional base stocks, including hydrocarbon base stocks, as well as with conventional lubricant additives. Moreover, the compounds may be used in a lubricant composition in a relatively high amount (for example, in an amount of greater than about 10% by weight, such as greater than about 20% by weight or greater than about 30% by weight) whilst meeting elastomer compatibility requirements for lubricant compositions.

The compounds of formula (A) and formula (1) may be prepared from a wide range of commercially available feedstocks.

In some embodiments, the compounds are prepared from bio-derived feedstocks. For instance, the compounds may contain greater than about 50%, such as greater than about 70%, or greater than about 80% by weight of biobased carbon. The biobased carbon content of the compounds may be measured according to ASTM D6866.

Guerbet-Derived Base Stocks

In preferred embodiments, the compounds of formula (1) are derived from β-alkylated alcohols. In these embodiments, the compound may have the formula (2):

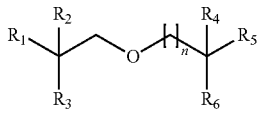

(2)

where:

$R_1$ and $R_2$ are alkyl or, together with the carbon atom to which they are attached, cycloalkyl;

$R_3$ and $R_5$ are H or alkyl;

$R_4$ is alkyl;

$R_6$ is alkyl or

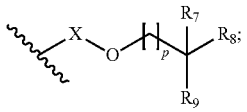

where:

$R_7$ and $R_8$ are H, alkyl or, together with the carbon atom to which they are attached, cycloalkyl;

$R_9$ is H or alkyl;

X is alkylene or is absent; and p is 0, 1, 2 or 3; and n is 0, 1, 2 or 3.

In some embodiments, $R_1$ and $R_2$ are $C_{1-15}$ alkyl or, together with the carbon atom to which they are attached, $C_{5-30}$ cycloalkyl, such as $C_{2-12}$ alkyl or, together with the carbon atom to which they are attached, $C_{5-25}$ cycloalkyl. Preferably, $R_1$ and $R_2$ are $C_{1-15}$ alkyl, such as $C_{2-12}$ alkyl.

In some embodiments, $R_3$ and $R_5$ are H or $C_{1-15}$ alkyl, such as H or $C_{2-12}$ alkyl. Preferably, $R_3$ and $R_5$ are H.

In some embodiments, $R_4$ is $C_{1-15}$ alkyl, such as $C_{2-12}$ alkyl.

In some embodiments, $R_6$ is $C_{1-15}$ alkyl or

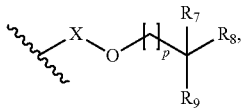

such as $C_{1-12}$ alkyl or

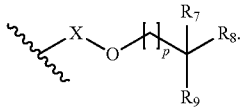

In some embodiments, $R_7$ and $R_8$ are H, $C_{1-20}$ alkyl or, together with the carbon atom to which they are attached, $C_{5-30}$ cycloalkyl, such as H, $C_{2-12}$ alkyl or, together with the carbon atom to which they are attached, $C_{5-25}$ cycloalkyl. Preferably, $R_7$ and $R_8$ are $C_{1-20}$ alkyl, such as $C_{2-12}$ alkyl.

In some embodiments, $R_9$ is H or $C_{1-20}$ alkyl, such as H or $C_{2-12}$ alkyl. Preferably, $R_9$ is H.

In some embodiments, X is $C_{1-20}$ alkylene, such as $C_{3-15}$ alkylene.

In some embodiments, p is 0, 1 or 2, such as 0 or 1.

In some embodiments, n is 0, 1 or 2, such as 0 or 1.

Where the compound is derived from a β-alkylated alcohol, it is preferably derived, at least in part, from a Guerbet alcohol. Compounds which are derived, at least in part, from Guerbet alcohols may have the formula (3):

(3)

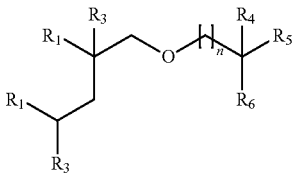

where:

$R_1$ is alkyl;

$R_3$ and $R_5$ are H or alkyl;

$R_4$ is alkyl;

$R_6$ is alkyl or

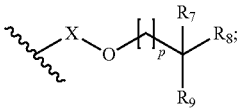

where:

$R_7$ and $R_8$ are H, alkyl or, together with the carbon atom to which they are attached, cycloalkyl;

$R_9$ is H or alkyl;

X is alkylene or is absent; and p is 0, 1, 2 or 3; and n is 0, 1, 2 or 3.

In some embodiments, $R_1$ is $C_{1-12}$ alkyl, such as $C_{2-10}$ alkyl.

In some embodiments, $R_3$ is H or $C_{1-12}$ alkyl, such as H or $C_{2-10}$ alkyl. Preferably, $R_3$ is H.

In some embodiments, $R_4$ is $C_{1-15}$ alkyl, such as $C_{2-12}$ alkyl.

In some embodiments, $R_5$ is H or $C_{1-15}$ alkyl, such as H or $C_{2-12}$ alkyl. Preferably, $R_5$ is H.

In some embodiments, $R_6$ is $C_{1-15}$ alkyl or

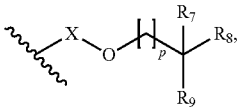

such as $C_{1-12}$ alkyl or

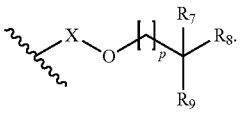

Preferably, $R_6$ is $C_{1-15}$ alkyl, such as $C_{1-12}$ alkyl.

In some embodiments, $R_7$ and $R_8$ are H, $C_{1-20}$ alkyl or, together with the carbon atom to which they are attached, $C_{5-30}$ cycloalkyl, such as H, $C_{2-12}$ alkyl or, together with the carbon atom to which they are attached, $C_{5-25}$ cycloalkyl. Preferably, $R_7$ and $R_8$ are $C_{1-20}$ alkyl, such as $C_{2-12}$ alkyl.

In some embodiments, $R_9$ is H or $C_{1-20}$ alkyl, such as H or $C_{2-12}$ alkyl. Preferably, $R_9$ is H.

In some embodiments, X is $C_{1-20}$ alkylene, such as $C_{3-15}$ alkylene.

In some embodiments, p is 0, 1 or 2, such as 0 or 1.

In some embodiments, n is 0, 1 or 2, such as 0 or 1.

One portion of the compound of formula (3) has a structure which may be derived from a Guerbet alcohol (i.e. the portion containing $R_1$ and $R_3$), whereas the other portion need not be derived from a Guerbet alcohol (i.e. the portion containing $R_4$, $R_5$ and $R_6$). However, in preferred embodiments, the compound may be derived from a combination of two Guerbet alcohols. A compound prepared in this way may have the formula (4):

(4)

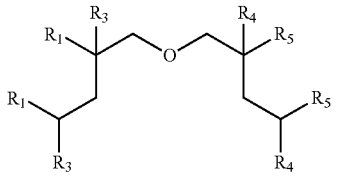

where:

$R_1$ and $R_4$ are alkyl;

$R_3$ and $R_5$ are H or alkyl.

In some embodiments, $R_1$ and $R_4$ are $C_{1-12}$ alkyl, such as $C_{2-10}$ alkyl.

In some embodiments, $R_3$ and $R_5$ are H or $C_{1-12}$ alkyl, such as H or $C_{2-10}$ alkyl. Preferably, $R_3$ and $R_5$ are H.

In particular embodiments:

$R_1$ is $C_{4-12}$ alkyl, such as $C_{6-10}$ alkyl;

$R_3$ is H;

$R_4$ is $C_{1-10}$ alkyl, such as $C_{2-8}$ alkyl; and $R_5$ is H.

Two different Guerbet alcohols may be combined to form compounds of formula (4), in which case $R_1$ and $R_4$ may be different. Alternatively, $R_3$ and $R_5$ may be different. In some embodiments, $R_1$ and $R_4$ are different and $R_3$ and $R_5$ are also different.

However, in some embodiments, the compound may be derived from a reaction in which the same Guerbet alcohols are combined. A compound prepared in this way may have the formula (5):

(5)

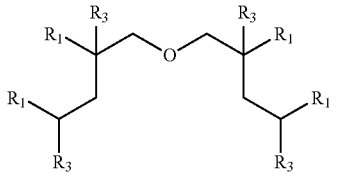

where:

$R_1$ is alkyl; and $R_3$ is H or alkyl.

In some embodiments, $R_1$ is $C_{1-10}$ alkyl, such as $C_{2-9}$ alkyl.

In some embodiments, $R_3$ is H or $C_{1-9}$ alkyl, such as H or $C_{2-8}$ alkyl. Preferably, $R_3$ is H.

In particular embodiments:

$R_1$ is $C_{3-10}$ alkyl, such as $C_{4-8}$ alkyl; and $R_3$ is H.

Compounds that are derived from Guerbet alcohols include compounds GE1-GE3, GE5, GE7-GE9, SE1, SE2 and TE1 as shown in Table 2.

Guerbet alcohols may be prepared, for example, by dimerising primary alcohols to form a β-alkylated alcohol product in a Guerbet reaction:

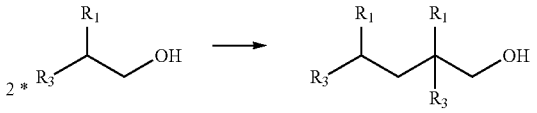

where $R_1$ and $R_3$ are as defined previously;

and/or:

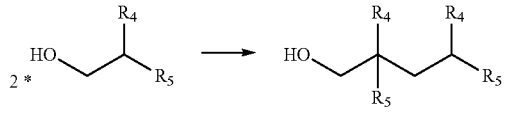

where $R_4$ and $R_5$ are as defined previously.

Guerbet reactions are well-known to the skilled person. The reactions are typically carried out at elevated temperatures in the presence of a catalyst.

The compound may be prepared from the Guerbet alcohol, for example, according to the following reaction:

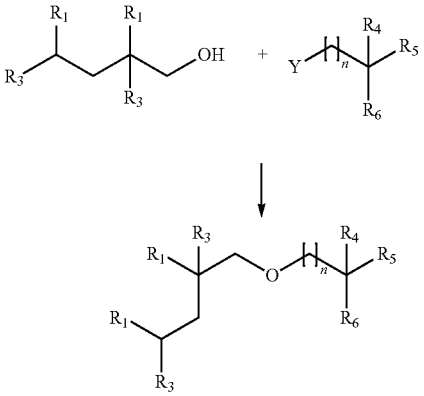

(3)

where:

Y is a leaving group; and $R_1$, $R_3$, $R_4$, $R_5$, $R_6$ and n are as defined previously for the compound of formula (3).

Where two Guerbet alcohols are combined to form a compound, one of the Guerbet alcohols may first be modified so that it contains a leaving group, Y, and the compound then prepared:

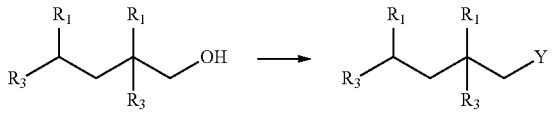

then:

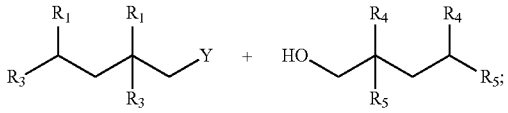

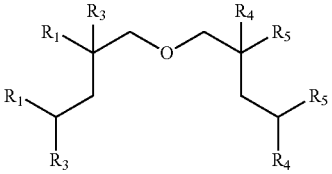

(4)

-continued or:

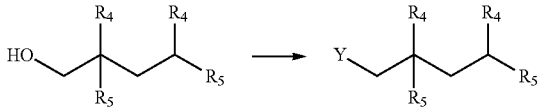

then:

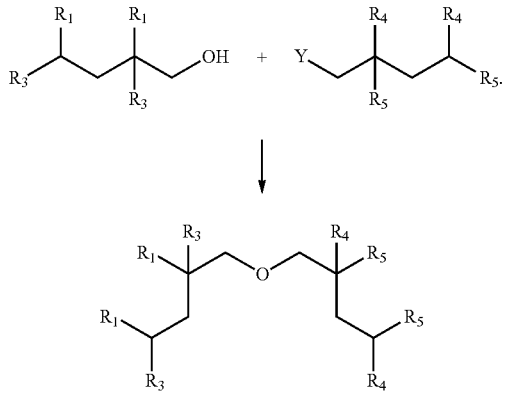

(4)

where:

Y is a leaving group; and $R_1$, $R_3$, $R_4$ and $R_5$ are as defined previously for the compound of formula (4).

Where the same Guerbet alcohols are combined to form a compound, they may be combined, for example, according to the following reactions:

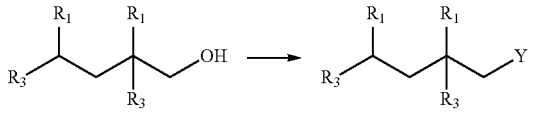

then:

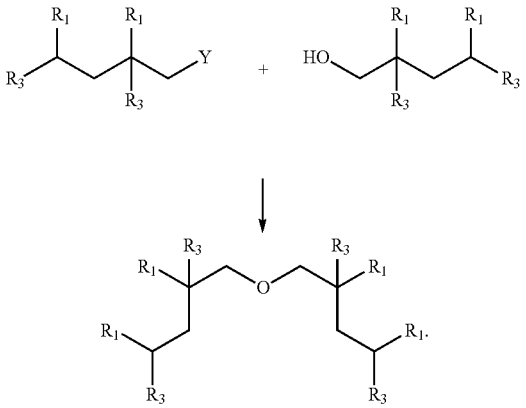

(5)

where:

Y is a leaving group; and $R_1$ and $R_3$ are as defined previously for the compound of formula (5).

Methods and reaction conditions for modifying a Guerbet alcohol so that it contains a leaving group, Y, are known to the skilled person. For instance, a mesylate group may be introduced by reacting the Guerbet alcohol with mesyl chloride in the presence of triethylamine. A bromide group may be introduced by reacting the Guerbet alcohol with N-bromosuccinimide and triphenyl phosphine.

Methods and reaction conditions for carrying out etherification reactions are known to the skilled person. A base (for example potassium hydroxide or potassium tert-butoxide), a catalyst (for example Starks' catalyst: N-Methyl-N,N,N-trioctyloctan-1-ammonium chloride) or both may be used in the abovementioned compound forming reactions, i.e. the etherification reactions.

In the abovementioned compound forming reactions, Y may be any suitable leaving group, such as a halogen (for example bromine, chlorine or iodine) or a sulfonate ester (for example mesylate or tosylate).

Secondary and Tertiary Ether Base Stocks

In some preferred embodiments, the compounds of formula (1) are secondary or tertiary ether compounds. In these embodiments, the compound may have the formula (6):

(6)

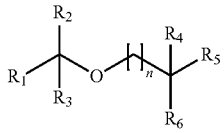

where:

$R_1$ and $R_2$ are alkyl or, together with the carbon to which they are attached, cycloalkyl;

$R_3$, $R_4$ and $R_5$ are H or alkyl;

$R_6$ is alkyl or

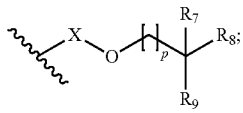

where:

$R_7$ and $R_8$ are H, alkyl or, together with the carbon atom to which they are attached, cycloalkyl;

$R_9$ is H or alkyl;

X is alkylene or is absent; and p is 0, 1, 2 or 3; and n is 0, 1, 2 or 3.

In some embodiments, $R_1$ and $R_2$ are $C_{1-15}$ alkyl or, together with the carbon atom to which they are attached, $C_{5-30}$ cycloalkyl, such as $C_{2-12}$ alkyl or, together with the carbon atom to which they are attached, $C_{5-25}$ cycloalkyl. Preferably, $R_1$ and $R_2$ are $C_{1-15}$ alkyl, such as $C_{2-12}$ alkyl.

In some embodiments, $R_3$, $R_4$ and $R_5$ are H or $C_{1-15}$ alkyl, such as H or $C_{2-12}$ alkyl. Preferably, $R_5$ is H.

In some embodiments, $R_6$ is $C_{1-20}$ alkyl or

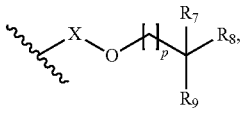

such as $C_{1-16}$ alkyl or

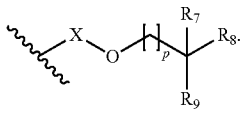

In some embodiments, $R_7$ and $R_8$ are H, $C_{1-20}$ alkyl or, together with the carbon atom to which they are attached, $C_{5-30}$ cycloalkyl, such as H, $C_{2-12}$ alkyl or, together with the carbon atom to which they are attached, $C_{5-25}$ cycloalkyl. Preferably, $R_7$ and $R_8$ are $C_{1-20}$ alkyl, such as $C_{2-12}$ alkyl.

In some embodiments, $R_9$ is H or $C_{1-20}$ alkyl, such as H or $C_{2-12}$ alkyl. Preferably, $R_9$ is H.

In some embodiments, X is $C_{1-20}$ alkylene, such as $C_{3-15}$ alkylene.

In some embodiments, p is 0, 1 or 2, such as 0 or 1.

In some embodiments, n is 0, 1 or 2, such as 0 or 1.

Secondary and tertiary ether compounds may have the formula (7):

(7)

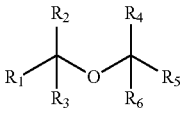

where:

$R_1$ and $R_2$ are alkyl or, together with the carbon to which they are attached, cycloalkyl;

$R_3$, $R_4$ and $R_5$ are H or alkyl; and $R_6$ is alkyl.

In some embodiments, $R_1$ and $R_2$ are $C_{1-15}$ alkyl or, together with the carbon to which they are attached, $C_{5-30}$ cycloalkyl, such as $C_{2-12}$ alkyl or, together with the carbon to which they are attached, $C_{5-25}$ cycloalkyl.

In some embodiments, $R_3$, $R_4$ and $R_5$ are H or $C_{1-15}$ alkyl, such as H or $C_{2-12}$ alkyl. Preferably, $R_5$ is H.

In some embodiments, $R_6$ is $C_{1-20}$ alkyl, such as $C_{1-16}$ alkyl.

The compounds may be secondary ether compounds of formula (8):

(8)

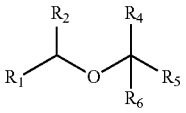

where:

$R_1$ and $R_2$ are alkyl or, together with the carbon to which they are attached, cycloalkyl;

$R_4$ and $R_5$ are H or alkyl; and $R_6$ is alkyl.

In some embodiments, $R_1$ and $R_2$ are $C_{1-15}$ alkyl, such as $C_{2-12}$ alkyl.

In other embodiments, the secondary ether may be obtained from a cyclic compound. In this case, $R_1$ and $R_2$, together with the carbon to which they are attached, form a cycloalkyl group, such as a $C_{5-30}$ cycloalkyl or a $C_{5-25}$ cycloalkyl. The cycloalkyl group may contain a cyclopentyl, cyclohexyl or cycloheptyl group optionally having one or more alkyl groups, such as $C_{1-12}$ alkyl or $C_{1-8}$ alkyl, attached thereto.

In some embodiments, $R_4$ and $R_5$ are H or $C_{1-15}$ alkyl, such as H or $C_{2-12}$ alkyl. Preferably, $R_5$ is H.

In some embodiments, $R_6$ is $C_{1-20}$ alkyl, such as $C_{1-16}$ alkyl.

In particular embodiments:

$R_1$ and $R_2$ are $C_{3-12}$ alkyl, such as $C_{5-10}$ alkyl;

$R_4$ and $R_5$ are H; and $R_6$ is $C_{4-20}$ alkyl, such as $C_{6-15}$ alkyl.

In other particular embodiments:

$R_1$ and $R_2$ are $C_{3-12}$ alkyl, such as $C_{5-10}$ alkyl;

$R_4$ is $C_{3-12}$ alkyl, such as $C_{5-10}$ alkyl;

$R_5$ is H; and $R_6$ is $C_{3-12}$ alkyl, such as $C_{5-10}$ alkyl.

The compounds may be tertiary ether compounds of formula (9):

(9)

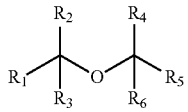

where:

$R_1$ and $R_2$ are alkyl or, together with the carbon to which they are attached, cycloalkyl;

$R_3$ is alkyl;

$R_4$ and $R_5$ are H or alkyl; and $R_6$ is alkyl.

In some embodiments, $R_1$ and $R_2$ are $C_{1-15}$ alkyl or, together with the carbon to which they are attached, $C_{5-30}$ cycloalkyl, such as $C_{2-12}$ alkyl or, together with the carbon to which they are attached, $C_{5-25}$ cycloalkyl. Preferably, $R_1$ and $R_2$ are $C_{1-15}$ alkyl, such as $C_{2-12}$ alkyl.

In some embodiments, $R_3$ is $C_{1-12}$ alkyl, such as $C_{1-10}$ alkyl.

In some embodiments, $R_4$ and $R_5$ are H or $C_{1-15}$ alkyl, such as H or $C_{2-12}$ alkyl.

In some embodiments, $R_6$ is $C_{1-20}$ alkyl, such as $C_{1-16}$ alkyl.

In particular embodiments:

$R_1$ and $R_2$ are $C_{2-12}$ alkyl, such as $C_{4-10}$ alkyl;

$R_3$ is $C_{1-10}$ alkyl, such as $C_{1-8}$ alkyl;

$R_4$ and $R_5$ are H; and $R_6$ is $C_{4-20}$ alkyl, such as $C_{6-15}$ alkyl.

In other particular embodiments:

$R_1$, $R_2$ and $R_3$ are $C_{2-12}$ alkyl, such as $C_{4-10}$ alkyl;

$R_3$ is $C_{1-10}$ alkyl, such as $C_{1-8}$ alkyl;

$R_4$ is $C_{3-12}$ alkyl, such as $C_{5-10}$ alkyl;

$R_5$ is H; and $R_6$ is $C_{3-12}$ alkyl, such as $C_{5-10}$ alkyl.

Examples of secondary and tertiary ether compounds include SE1, SE2 and TE1 as shown in Table 2.

The secondary and tertiary ether compounds may be prepared according to the following reactions:

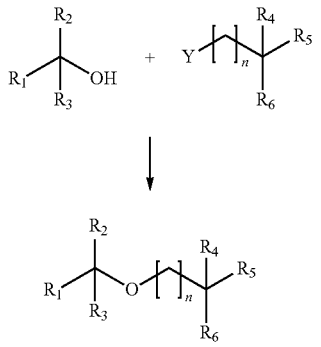

(6)

or:

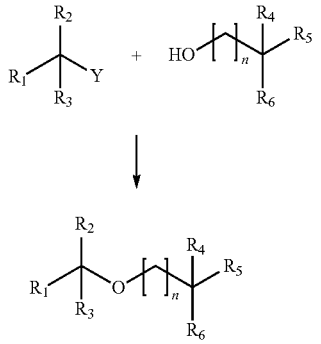

(6)

where:

Y is a leaving group; and $R_1$, $R_2$, $R_3$, $R_4$, $R_5$, $R_6$ and n are as defined previously for the compound of formula (6).

Similarly:

(7)

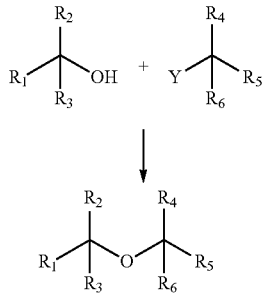

or:

(7)

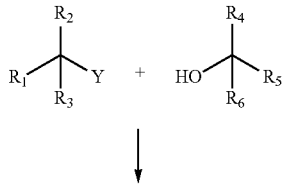

-continued

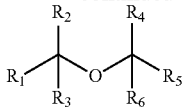

where:

Y is a leaving group; and $R_1$, $R_2$, $R_3$, $R_4$, $R_5$ and $R_6$ are as defined previously for the compound of formula (7).

The skilled person will be aware of methods and reaction conditions for carrying out these etherification reactions. For instance, the reaction may be carried out in the presence of magnesium sulfate, sulfuric acid and dichloromethane.

Secondary and tertiary alcohol starting materials for use in etherification reactions will generally be commercially available, or they may be obtained from commercially available ketones.

The groups

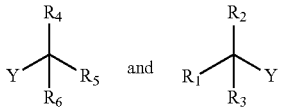

and may be prepared by introducing a leaving group, Y, into the alcohol starting materials. Methods and reaction conditions for introducing the leaving group into alcohol are known to the skilled person.

In the abovementioned secondary and tertiary ether compound forming reactions, Y may be any suitable leaving group, such as a halogen (for example bromine, chlorine or iodine) or a sulfonate ester (for example mesylate or tosylate).

Secondary or Tertiary Ethers Derived from a Guerbet Alcohol

In some embodiments, the compound may comprise an ether which is derived on one side from a secondary or tertiary alcohol and is derived on the other side from a Guerbet alcohol. In these embodiments, the compound may have the formula (10):

(10)

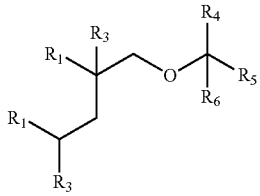

where:

$R_1$ and $R_4$ are alkyl;

$R_3$ and $R_5$ are H or alkyl;

$R_6$ is alkyl or

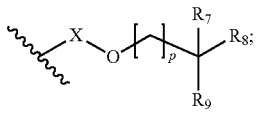

where:

$R_7$ and $R_8$ are H, alkyl or, together with the carbon atom to which they are attached, cycloalkyl;

$R_9$ is H or alkyl;

X is alkylene or is absent; and and p is 0, 1, 2 or 3.

In some embodiments, $R_1$ is $C_{1-12}$ alkyl, such as $C_{2-10}$ alkyl.

In some embodiments, $R_3$ is H or $C_{1-12}$ alkyl, such as H or $C_{2-10}$ alkyl. Preferably, $R_3$ is H.

In some embodiments, $R_4$ is $C_{1-15}$ alkyl, such as $C_{2-12}$ alkyl.

In some embodiments, $R_5$ is H or $C_{1-15}$ alkyl, such as H or $C_{2-12}$ alkyl. Preferably, $R_5$ is H.

In some embodiments, $R_6$ is $C_{1-15}$ alkyl or

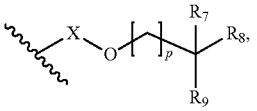

such as $C_{1-12}$ alkyl or

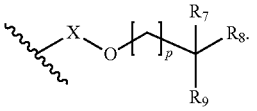

In some embodiments, $R_7$ and $R_8$ are H, $C_{1-20}$ alkyl or, together with the carbon atom to which they are attached, $C_{5-30}$ cycloalkyl, such as H, $C_{2-12}$ alkyl or, together with the carbon atom to which they are attached, $C_{5-25}$ cycloalkyl. Preferably, $R_7$ and $R_8$ are $C_{1-20}$ alkyl, such as $C_{2-12}$ alkyl.

In some embodiments, $R_9$ is H or $C_{1-20}$ alkyl, such as H or $C_{2-12}$ alkyl. Preferably, $R_9$ is H.

In some embodiments, X is $C_{1-20}$ alkylene, such as $C_{3-15}$ alkylene.

In some embodiments, p is 0, 1 or 2, such as 0 or 1.

Examples of secondary and tertiary ether compounds derived from a Guerbet-alcohol include compounds SE1, SE2 and TE1 as shown in Table 2.

Di-Ether Base Stocks

It is generally preferred that the compounds of formula (1) are monoethers. However, in some embodiments, the compound is a diether compound. Such compounds may have the formula (11):

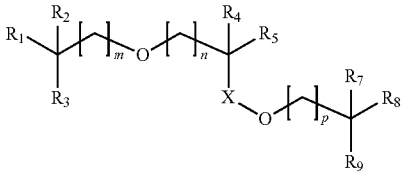

(11)

where:

$R_1$ and $R_2$ are alkyl or, together with the carbon atom to which they are attached, cycloalkyl;

$R_3$, $R_4$ and $R_5$ are H or alkyl;

$R_7$ and $R_8$ are H, alkyl or, together with the carbon atom to which they are attached, cycloalkyl;

$R_9$ is H or alkyl;

X is alkylene or is absent;

p is 0, 1, 2 or 3; and m and n are 0, 1, 2 or 3.

In some embodiments, $R_1$ and $R_2$ are $C_{1-15}$ alkyl or, together with the carbon to which they are attached, $C_{5-30}$ cycloalkyl, such as $C_{2-12}$ alkyl or, together with the carbon to which they are attached, $C_{5-25}$ cycloalkyl. Preferably, $R_1$ and $R_2$ are $C_{1-15}$ alkyl, such as $C_{2-12}$ alkyl.

In some embodiments, $R_3$, $R_4$ and $R_5$ are H or $C_{1-15}$ alkyl, such as H or $C_{2-12}$ alkyl. Preferably, $R_3$ and $R_5$ are H.

In some embodiments, $R_7$ and $R_8$ are H, $C_{1-20}$ alkyl or, together with the carbon atom to which they are attached, $C_{5-30}$ cycloalkyl, such as H, $C_{2-12}$ alkyl or, together with the carbon atom to which they are attached, $C_{5-25}$ cycloalkyl. Preferably, $R_7$ and $R_8$ are $C_{1-20}$ alkyl, such as $C_{2-12}$ alkyl.

In some embodiments, $R_9$ is H or $C_{1-20}$ alkyl, such as H or $C_{2-12}$ alkyl. Preferably, $R_9$ is H.

In some embodiments, X is $C_{1-20}$ alkylene, such as $C_{3-15}$ alkylene.

In some embodiments, p is 0, 1 or 2, such as 0 or 1.

In some embodiments, m and n are 0, 1 or 2, such as 0 or 1.

In some embodiments, the diether compound may contain two ether groups, at least one of which is derived from a β-alkylated alcohol. In such embodiments, the compound may have the formula (12):

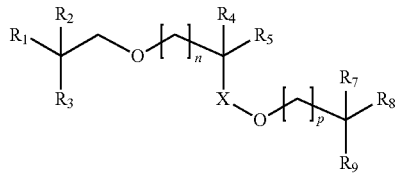

(12)

where:

$R_1$ and $R_2$ are alkyl or, together with the carbon atom to which they are attached, cycloalkyl;

$R_3$, $R_4$ and $R_5$ are H or alkyl;

$R_7$ and $R_8$ are H, alkyl or, together with the carbon atom to which they are attached, cycloalkyl;

$R_9$ is H or alkyl;

X is alkylene or is absent;

p is 0, 1, 2 or 3; and n is 0, 1, 2 or 3.

In some embodiments, $R_1$ and $R_2$ are $C_{1-15}$ alkyl or, together with the carbon atom to which they are attached, $C_{5-30}$ cycloalkyl, such as $C_{2-12}$ alkyl or, together with the carbon atom to which they are attached, $C_{5-25}$ cycloalkyl. Preferably, $R_1$ and $R_2$ are $C_{1-15}$ alkyl, such as $C_{2-12}$ alkyl.

In some embodiments, $R_3$, $R_4$ and $R_5$ are H or $C_{1-15}$ alkyl, such as H or $C_{2-12}$ alkyl. Preferably, $R_3$ and $R_5$ are H. Preferably, $R_4$ is $C_{1-15}$ alkyl, such as $C_{2-12}$ alkyl In some embodiments, $R_7$ and $R_8$ are H, $C_{1-20}$ alkyl or, together with the carbon atom to which they are attached, $C_{5-30}$ cycloalkyl, such as H, $C_{2-12}$ alkyl or, together with the carbon atom to which they are attached, $C_{5-25}$ cycloalkyl. Preferably, $R_7$ and $R_8$ are $C_{1-20}$ alkyl, such as $C_{2-12}$ alkyl.

In some embodiments, $R_9$ is H or $C_{1-20}$ alkyl, such as H or $C_{2-12}$ alkyl. Preferably, $R_9$ is H.

In some embodiments, X is $C_{1-20}$ alkylene, such as $C_{3-15}$ alkylene.

In some embodiments, p is 0, 1 or 2, such as 0 or 1.

In some embodiments, n is 0, 1 or 2, such as 0 or 1.

Examples of Guerbet-derived base stocks GE1-GE9, secondary ether base stocks SE1 and SE2, and tertiary ether base stock TE1 of formula (1), which may preferably be used in connection with the present application, are shown in Table 2.

TABLE 2

| | Molecular Weight | Chemical Formula | Structure |
|---|---|---|---|
| GE1 | 466.87 | $C_{32}H_{66}O$ | |
| GE2 | 466.87 | $C_{32}H_{66}O$ | |
| GE3 | 522.97 | $C_{36}H_{74}O$ | |
| GE4 | 466.87 | $C_{32}H_{66}O$ | |
| GE5 | 410.76 | $C_{28}H_{58}O$ | |
| GE6 | 466.87 | $C_{32}H_{66}O$ | |
| GE7 | 522.57 | $C_{36}H_{74}O$ | |
| GE8 | 382.42 | $C_{26}H_{54}O$ | |
| GE9 | 466.51 | $C_{32}H_{66}O$ | |
| GE10 | 410.76 | $C_{28}H_{58}O$ | |
| GE12 | 382.71 | $C_{26}H_{54}O$ | |
| GE14 | 410.76 | $C_{28}H_{58}O$ | |
| GE15 | 354.65 | $C_{24}H_{50}O$ | |

TABLE 2-continued

| | Molecular Weight | Chemical Formula | Structure |
|---|---|---|---|
| GE16 | 424.79 | $C_{29}H_{60}O$ | 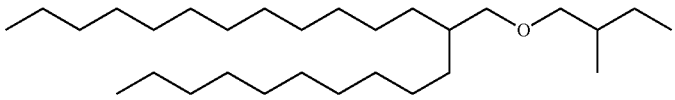 |
| GE18 | 438.81 | $C_{30}H_{62}O$ | 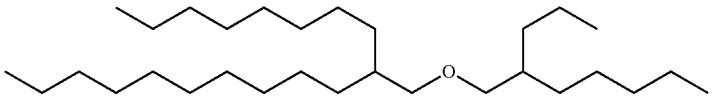 |
| GE20 | 354.65 | $C_{24}H_{50}O$ | 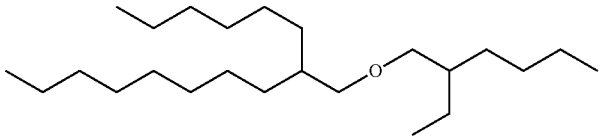 |
| GE21 | 382.71 | $C_{26}H_{54}O$ | 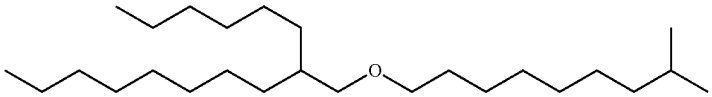 |
| GE22 | 410.76 | $C_{28}H_{58}O$ | 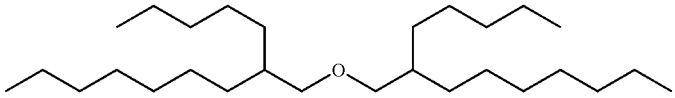 |
| GE23 | 382.71 | $C_{26}H_{54}O$ | 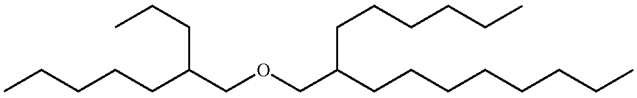 |
| SE1 | 452.84 | $C_{31}H_{64}O$ | 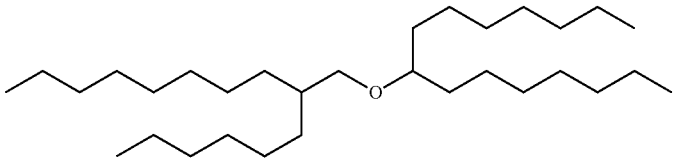 |
| SE2 | 396.43 | $C_{27}H_{56}O$ | 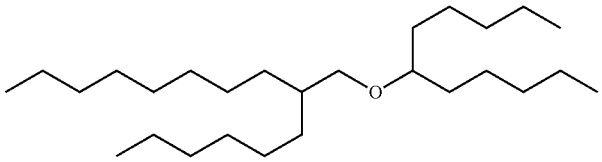 |
| TE1 | 466.87 | $C_{32}H_{66}O$ | 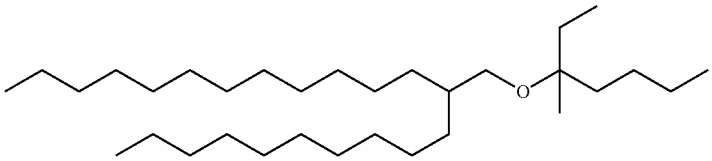 |

Base Oils and Lubricant Compositions

The ether compounds of formula (A), or the subset thereof of formula (1), are used as part of a base oil in accordance with the present invention.

The base oils may contain an amount of compound of formula (A), or a compound of the subset thereof of formula (1), which is sufficient to impart beneficial properties of the compound onto the base oil.

In some embodiments, the base oil comprises greater than about 5%, such as greater than about 25%, or greater than about 40% by weight of ether compound of formula (A), or the subset thereof of formula (1). The base oil may comprise up to about 100%, such as up to about 90% of compound of formula (A), or of the subset thereof of formula (1). The compound of formula (A), or of the subset thereof of formula (1), in the base oil may be composed of a single compound or a combination of compounds of formula (A), or of the subset thereof of formula (1).

The remainder of the base oil may be made up with base stocks which are not compounds of formula (A) and formula (1). Base stocks other than those of formula (A) and formula (1) which are suitable for use in the base oil include non-aqueous base stocks, such as Group I, Group II, Group III, Group IV and Group V base stocks. The remainder of the base oil may comprise a single base stock or a combination of base stocks other than those of formula (A) and formula (1).

The base oils are used as part of the lubricant composition in accordance with the present invention.

The lubricant compositions may contain an amount of base oil which is sufficient to impart beneficial properties of the compound of formula (A), or a compound of the subset thereof of formula (1), onto the lubricating composition.

In some embodiments, the lubricant composition comprises greater than about 50%, such as greater than about 65%, or greater than about 80% by weight of base oil. The base oil may be composed of a single base oil or a combination of base oils comprising compound of formula (A), or of the subset thereof of formula (1).

The lubricant composition comprises at least one aminic anti-oxidant and at least one phenolic anti-oxidant. In some embodiments, the total combined amount of aminic and phenolic antioxidant is no more than 4%, by weight of the lubricant composition. In preferred embodiments, the lubricant compositions have a total combined amount of aminic and phenolic anti-oxidant in the lubricant composition of not more than 3.0%, not more than 2.5%, or not more than 2.0%, by weight of the lubricant composition. In preferred embodiments, the lubricant compositions have a total combined amount of aminic and phenolic anti-oxidant in the lubricant composition of at least 0.25%, at least 0.5%, or at least 1.0%, by weight of the lubricant composition.

Any total combined amount of aminic and phenolic anti-oxidant may be present in the lubricant composition of the invention provided it does not exceed 4%, by weight of the lubricant composition. Thus, any sub-range of anti-oxidant concentration which lies within the above range may be used in accordance with the invention. For example, all sub-ranges formed from the combination of a lower weight percentage limit of 0.1, 0.2, 0.3, 0.4, 0.5, 0.6, 0.7, 0.8, 0.9, 1.0, 1.1, 1.2, 1.3, 1.4, 1.5 together with an upper weight percentage limit of 4.0, 3.9, 3.8, 3.7, 3.6, 3.5, 3.4, 3.3, 3.2, 3.1, 3.0, 2.9, 2.8, 2.7, 2.6, 2.5, 2.4, 2.3, 2.2, 2.1 or 2.0 may be utilized in accordance with the present invention.

In some embodiments, the weight ratio of aminic anti-oxidant to phenolic anti-oxidant in the lubricant composition is from 4:1 to 1:4, preferably from 3:1 to 1:3, more preferably from 2:1 to 1:2.

A particular advantage of the present invention relates to the oxidative stability conferred to the lubricant composition by the presence of ether compounds of formula (A), or of the subset thereof of formula (1). This allows desirable oxidative stability properties to be attained in the composition without the need for the same total concentration of aminic and phenolic antioxidants as would usually be required in a comparable lubricant composition which is formulated without any ether compounds of formula (A) or formula (1). A total combined aminic and phenolic antioxidant level representative of a high performance engine oil may exceed 5%, by weight of the lubricant composition. The present invention enables the use of much lower concentrations of total combined aminic and phenolic antioxidants to achieve the same or better oxidative stability properties, both before and during use, for instance, in an internal combustion engine, compared to conventional lubricant compositions, which do not contain any ether compounds of formula (A) or formula (1), and which comprise the same aminic and phenolic antioxidants but in higher concentration. This is of particular benefit from a cost perspective as well as from a lubricant composition lifetime, fuel economy and piston cleanliness perspective. A reduction in aminic anti-oxidant in a lubricant composition for an internal combustion engine has a particular benefit in reducing turbocharger deposits as well as a reduction in copper corrosion and an increase in elastomer compatibility. Meanwhile, a reduction in phenolic antioxidant leads to an improvement in environmental toxicity of the lubricant compositions.

It has also been found that the particularly desirable oxidative stability properties of the lubricant compositions of the present invention also derive from the presence of both phenolic and aminic antioxidants, which has been observed to significantly enhance the oxidative stability of the lubricant composition compared to the use of either of the phenolic or aminic antioxidant singly. In particular, a surprising synergy has been shown in CEC-L-85-99 testing in terms of oxidation onset time and a method similar to ASTM E2009(B) oxidation induction temperature for ether compositions comprising both phenolic and aminic antioxidants. These effects are not observed with corresponding non-ether based compositions comprising phenolic and aminic antioxidants. The beneficial effects of the ether base stock, coupled with the presence of phenolic or aminic antioxidant, serves to substantially increase the oxidative stability of the lubricant composition to the extent that the total combined amount of aminic and phenolic antioxidant present may be significantly reduced yet achieve similar or improved oxidation stability properties compared to a conventional non-ether based composition comprising higher total amounts of aminic and phenolic oxidant. As mentioned above, by reducing the level of aminic and phenolic antioxidants there are environmental, engine deposit and elastomer compatibility benefits observed.

It is common to add one or more anti-wear additives to a lubricant composition, examples of which include zinc dihydrocarbyl dithiophosphates (ZDDP). In addition, it has also been found that some of the beneficial effects of the invention are not impacted by the presence of ZDDP as, in contrast, is observed to be the case with non-ether based lubricant compositions. Surprisingly, some of the beneficial effects of the invention are even enhanced by the presence of ZDDP in the lubricant compositions. For instance, the presence of ZDDP has been observed to exacerbate oxidative thickening in CEC-L-109 tests relating to non-ether based compositions comprising aminic and/or phenolic antioxidants. In contrast, the presence of ZDDP, together with aminic and phenolic antioxidants in the ether-based compositions of the invention gives surprisingly high oxidative stability and resistance to oxidative thickening in the CEC-L-109 tests, which are indicative of a synergy between the ether base stock in the lubricant composition and the ZDDP and antioxidant components. Consequently, an additional benefit of the present invention is that greater amounts of ZDDP can be used with the ether compositions of the invention without significantly impacting upon the oxidative stability of the composition, such that the full anti-wear benefit of ZDDP can be realized.

Further still, it has also been found that some of the beneficial effects of the invention are not impacted by the presence of significant amounts of boron or magnesium in the lubricant compositions, for instance in the form of borated dispersants or magnesium detergents as, in contrast, is observed to be the case with non-ether based lubricant compositions. The presence of borated dispersant and/or other boron containing additives or magnesium gives rise to a substantial increase in percentage change in Kinematic Viscosity at 100° C. for non-ether based lubricant compositions in CEC-L-109 tests. In contrast, the presence of boron and/or magnesium in ether-based compositions according to the invention is well tolerated without significant increases in oxidative thickening. This is of particular benefit since an increase in boron in the lubricant compositions leads to increased elastomer compatibility and reduced corrosion of the lubricated surfaces, whilst magnesium reduces the occurrence of low-speed pre-ignition.

The aminic and phenolic antioxidants present in the compositions of the invention are not particularly limited, provided that they are suitable for use in a lubricant composition intended for use in an internal combustion engine, for instance an internal combustion engine of an automotive vehicle.

In some embodiments, the phenolic anti-oxidant is selected from alkylated mono-phenols, alkylated hydroquinones, hydroxylated thiodiphenyl ethers, alkylidenebisphenols, acylaminophenols, and sulphurised alkyl phenols and alkali and alkaline earth metal salts thereof. In preferred embodiments, the phenolic anti-oxidant is selected from 2-t-butyl-4-heptyl phenol, 2-t-butyl-4-octyl phenol, 2-t-butyl-4-dodecyl phenol, 2,6-di-t-butyl-4-methylphenol, 2,6-di-t-butyl-4-heptylphenol, 2,6-di-t-butyl-4-dodecylphenol, 2-methyl-6-t-butyl-4-heptylphenol, 2-methyl-6-t-butyl-4-dodecylphenol, 4,4'-methylenebis(2,6-di-t-butylphenol), 2'-bis(4-heptyl-6-t-butylphenol), 2,2'-bis(4-octyl-6-t-butylphenol), 2,2'-bis(4-dodecyl-6-t-butylphenol), 4,4'-bis(2,6-di-t-butylphenol), 4,4'-methylene-bis(2,6-di-t-butylphenol) and derivatives thereof.

In some embodiments, the aminic anti-oxidant is selected from alkylated and non-alkylated aromatic amines, alkylated diphenylamines, N-alkylated phenylenediamines, phenyl-α-naphthylamine, and alkylated phenyl-α-naphthylamines. In preferred embodiments, the aminic anti-oxidant is selected from p,p-dioctylphenylamine, t-octylphenyl-α-naphthylamine, p-octylphenyl-α-naphthylamine, monooctyldiphenylamine, N,N-di(2-naphthyl)-p-phenylenediamine, phenyl-1-naphthylamine, phenyl-2-naphthylamine, an alkylphenyl-1-naphthylamine, an alkylphenyl-2-naphthylamine and derivatives thereof.

The lubricant composition may also comprise other antioxidants which are not aminic or phenolic in nature. For example, the lubricant compositions of the invention may additionally comprise antioxidants selected from hydroxylated thiodiphenyl ethers, thiopropionates, metallic dithiocarbamates, 1,3,4-dimercaptothiadiazole and derivatives, oil soluble copper compounds (for example, copper dihydrocarbyl thio- or thio-phosphate, copper salts of a synthetic or natural carboxylic acids, for example a $C_8$ to $C_{18}$ fatty acid, an unsaturated acid or a branched carboxylic acid, for example basic, neutral or acidic Cu(I) and/or Cu(II) salts derived from alkenyl succinic acids or anhydrides), alkaline earth metal salts of alkylphenolthioesters, suitably containing $C_5$ to $C_{12}$ alkyl side chains, barium t-octylphenyl sulphide, phosphosulphised or sulphurised hydrocarbons, oil soluble phenates, oil soluble sulphurised phenates, phosphosulphurised hydrocarbons, sulphurised hydrocarbons, phosphorus esters, low sulphur peroxide decomposers and the like.

As will be appreciated, it is preferred that non-aminic and non-phenolic antioxidants are used in minimal amounts where they are present. In some embodiments, the total amount of non-aminic and non-phenolic antioxidant in the lubricant compositions is not more than 1.0%, not more than 0.75%, or not more than 0.5%, by weight of the lubricant composition. In some embodiments, the antioxidant present in the lubricant compositions consists, or consists essentially of, aminic and phenolic antioxidant.

The lubricant composition may also comprise other lubricant additives, in addition to antioxidants. The additional lubricant additives will typically be present in the lubricant composition in an amount of from about 2% to about 40% by weight, such as about 3% to about 30% by weight.

Suitable additional lubricant additives include detergents (including metallic and non-metallic detergents), friction modifiers, viscosity modifiers, dispersants (including metallic and non-metallic dispersants), dispersant viscosity modifiers, viscosity index improvers, pour point depressants, anti-wear additives, rust inhibitors, corrosion inhibitors, antioxidants (sometimes also called oxidation inhibitors), anti-foams (sometimes also called anti-foaming agents), seal swell agents (sometimes also called seal compatibility agents), extreme pressure additives (including metallic, non-metallic, phosphorus containing, non-phosphorus containing, sulphur containing and non-sulphur containing extreme pressure additives), surfactants, demulsifiers, anti-seizure agents, wax modifiers, lubricity agents, anti-staining agents, chromophoric agents, metal deactivators, and mixtures of two or more thereof.

In some embodiments, the lubricant composition comprises a detergent. Examples of detergents include ashless detergents (that is, non-metal containing detergents) and metal-containing detergents. Suitable non-metallic detergents are described for example in U.S. Pat. No. 7,622,431. Metal-containing detergents comprise at least one metal salt of at least one organic acid, which is called soap or surfactant. Suitable organic acids include for example, sulphonic acids, phenols (suitably sulphurised and including for example, phenols with more than one hydroxyl group, phenols with fused aromatic rings, phenols which have been modified for example, alkylene bridged phenols, and Mannich base-condensed phenols and saligenin-type phenols, produced for example by reaction of phenol and an aldehyde under basic conditions) and sulphurised derivatives thereof, and carboxylic acids including for example, aromatic carboxylic acids (for example hydrocarbyl-substituted salicylic acids and derivatives thereof, for example hydrocarbyl substituted salicylic acids and sulphurised derivatives thereof).

Advantageously, magnesium detergents may also be used in the lubricant compositions of the present invention without negatively impacting oxidative stability. In some embodiments, the amount of magnesium contained in the lubricant composition is from 0.025 wt. % to 0.5 wt. %, preferably from 0.05 wt. % to 0.4 wt. %, more preferably from 0.08 wt. % to 0.35 wt. %, most preferably from 0.1 wt. % to 0.25 wt. %. This level of elemental magnesium may be derived from the use of magnesium detergents and/or other magnesium-containing additives or otherwise.

In some embodiments, the lubricant composition comprises a friction modifier. Suitable friction modifiers include for example, ash-producing additives and ashless additives. Examples of suitable friction modifiers include fatty acid derivatives including for example, fatty acid esters, amides, amines, and ethoxylated amines. Examples of suitable ester friction modifiers include esters of glycerol for example, mono-, di-, and tri-oleates, mono-palmitates and mono-myristates. A particularly suitable fatty acid ester friction modifier is glycerol monooleate. Examples of suitable friction modifiers also include molybdenum compounds for example, organo molybdenum compounds, molybdenum dialkyldithiocarbamates, molybdenum dialkylthiophosphates, molybdenum disulphide, tri-molybdenum cluster dialkyldithiocarbamates, non-sulphur molybdenum compounds and the like. Suitable molybdenum-containing compounds are described for example, in EP 1533362 A1 for example in paragraphs [0101] to [0117].

In some embodiments, the lubricant composition comprises a dispersant. Examples of suitable ashless dispersants include oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons containing polyamine moieties attached directly thereto; Mannich condensation products formed by condensing a long chain substituted phenol with formaldehyde and polyalkylene polyamine; Koch reaction products and the like. Particularly preferred dispersants for use in the present invention are long chain aliphatic hydrocarbons containing polyamine moieties attached directly thereto such as polyisobutylene succinyl anhydride-polyamines (PIBSA-PAM).

Advantageously, borated dispersants may also be used in the lubricant compositions of the present invention without negatively impacting oxidative stability. In some embodiments, the lubricant composition may contain boron in an amount from 0.005 wt. % to 0.05 wt. %, preferably from 0.0075 wt. % to 0.035 wt. %. This level of elemental boron may be derived from the use of a borated dispersants and/or boron-containing anti-wear additives or otherwise.

In some embodiments, the lubricant composition comprises a dispersant viscosity modifier. Examples of suitable dispersant viscosity modifiers and methods of making them are described in WO 99/21902, WO 2003/099890 and WO 2006/099250.

In some embodiments, the lubricant composition comprises a viscosity index improver. Examples of suitable viscosity modifiers include high molecular weight hydrocarbon polymers (for example polyisobutylene, copolymers of ethylene and propylene and higher alpha-olefins); polyesters (for example polymethacrylates); hydrogenated poly (styrene-co-butadiene or isoprene) polymers and modifications (for example star polymers); and esterified poly (styrene-co-maleic anhydride) polymers. Oil-soluble viscosity modifying polymers generally exhibit number average molecular weights of at least about 15,000 to about 1,000,000, such as about 20,000 to about 600,000 as determined by gel permeation chromatography or light scattering methods.

In some embodiments, the lubricant composition comprises a pour point depressant. Examples of suitable pour point depressants include $C_8$ to $C_{18}$ dialkyl fumarate/vinyl acetate copolymers, methacrylates, polyacrylates, polyarylamides, polymethacrylates, polyalkyl methacrylates, vinyl fumarates, styrene esters, condensation products of haloparaffin waxes and aromatic compounds, vinyl carboxylate polymers, terpolymers of dialkyfumarates, vinyl esters of fatty acids and allyl vinyl ethers, wax naphthalene and the like.

In some embodiments, the lubricant composition comprises at least one anti-wear additive. Examples of suitable anti-wear additives include non-phosphorus containing additives for example, sulphurised olefins. Examples of suitable anti-wear additives also include phosphorus-containing anti-wear additives. Examples of suitable ashless phosphorus-containing anti-wear additives include trilauryl phosphite and triphenylphosphorothionate and those disclosed in paragraph [0036] of US 2005/0198894. Examples of suitable ash-forming, phosphorus-containing anti-wear additives include dihydrocarbyl dithiophosphate metal salts. Examples of suitable metals of the dihydrocarbyl dithiophosphate metal salts include alkali and alkaline earth metals, aluminium, lead, tin, molybdenum, manganese, nickel, copper and zinc. Particularly suitable dihydrocarbyl dithiophosphate metal salts are zinc dihydrocarbyl dithiophosphates (ZDDP).

In some embodiments, the amount of phosphorus contained in the lubricant composition is less than 0.5 wt. %, preferably from 0.001 to 0.3 wt. %, more preferably from 0.025 to 0.2 wt. %, and even more preferably from 0.04 to 0.12 wt. %, based on the total weight of the lubricant composition.

Since ZDDP is particularly well tolerated in terms of oxidative stability of the lubricant compositions of the invention, and appears also to confer synergistic effects when used in combination with the ether base stock and antioxidants, the use of ZDDP in the compositions of the present invention is particularly beneficial to the overall properties of the lubricant composition, particularly from an anti-wear perspective. Thus, in some embodiments, the amount of dihydrocarbyl dithiophosphate metal salts, preferably in the form of zinc dihydrocarbyl dithiophosphates (ZDDP), in the lubricant composition is from 0.01 wt. % to 10.0 wt. %, preferably from 0.1 wt. % to 5 wt. %, more preferably from 0.2 wt. % to 2.5 wt. % and even more preferably from 0.3 wt. % to 1.0 wt. %.

In some embodiments, the lubricant composition comprises a rust inhibitor. Examples of suitable rust inhibitors include non-ionic polyoxyalkylene polyols and esters thereof, polyoxyalkylene phenols, polyoxyalkylene polyols, anionic alky sulphonic acids, zinc dithiophosphates, metal phenolates, basic metal sulphonates, fatty acids and amines.

In some embodiments, the lubricant composition comprises a corrosion inhibitor. Examples of suitable corrosion inhibitors include phosphosulphurised hydrocarbons and the products obtained by the reaction of phosphosulphurised hydrocarbon with an alkaline earth metal oxide or hydroxide, non-ionic polyoxyalkylene polyols and esters thereof, polyoxyalkylene phenols, thiadiazoles, triazoles and anionic alkyl sulphonic acids. Examples of suitable epoxidised ester corrosion inhibitors are described in US 2006/0090393.

In some embodiments, the lubricant composition comprises an antifoam agent. Examples of suitable anti-foam agents include silicones, organic polymers, siloxanes (including poly siloxanes and (poly) dimethyl siloxanes, phenyl methyl siloxanes), acrylates and the like.

In some embodiments, the lubricant composition comprises a seal swell agent. Examples of suitable seal swell agents include long chain organic acids, organic phosphates, aromatic esters, aromatic hydrocarbons, esters (for example butylbenzyl phthalate) and polybutenyl succinic anhydride.

The lubricant composition may comprise lubricant additives in the amounts shown in Table 3.

TABLE 3

| Additive type | Lubricant composition: Suitable amount (actives) if present by weight | Lubricant composition: Preferred amount (actives) if present by weight |
|---|---|---|
| Phosphorus-containing anti-wear additives | Corresponding to about 10 to about 6000 ppm P | Corresponding to about 10 to about 1000 ppm P |
| Molybdenum-containing anti-wear additives | Corresponding to about 10 to about 1000 ppm Mo | Corresponding to about 40 to about 600 ppm Mo |
| Boron-containing anti-wear additives | Corresponding to about 10 to about 500 ppm B | Corresponding to about 50 to about 350 ppm B |
| Friction modifiers | About 0.01 to about 5% | About 0.01 to about 1.5% |
| Molybdenum-containing friction modifiers | Corresponding to about 10 to about 1000 ppm Mo | Corresponding to about 400 to about 600 ppm Mo |
| Molybdenum-containing additives (e.g. both anti-wear additives and friction modifiers) | Corresponding to about 10 to about 2000 ppm Mo | Corresponding to about 40 to about 1200 ppm Mo |
| Dispersants | About 0.1 to about 20% | About 0.1 to about 8% |
| Detergents | About 0.01 to about 6% | About 0.01 to about 4% |
| Viscosity index improvers | About 0.01 to about 20% | About 0.01 to about 15% |
| Pour point depressants | About 0.01 to about 5% | About 0.01 to about 1.5% |
| Corrosion and/or rust inhibitors | About 0.01 to about 5% | About 0.01 to about 1.5% |
| Antifoams containing silicon | Corresponding to about 1 to about 20 ppm Si | Corresponding to about 1 to about 10 ppm Si |

The lubricant compositions may have a kinematic viscosity at 40° C. of less than about 60 cSt, such as less than about 55 cSt, or less than about 50 cSt. The lubricant compositions may have a kinematic viscosity at 100° C. of less than about 12 cSt, such as less than about 10 cSt, or less than about 9.5 cSt. The lubricant compositions may have a viscosity index of greater than about 100, such as greater than about 110, or greater than about 120. The kinematic viscosity at 40° C. and the kinematic viscosity at 100° C. may be measured according to ASTM D445. The viscosity index may be calculated according to ASTM D2270.

The lubricant compositions may have a Noack volatility of less than about 25%, such as less than about 15%, or less than about 10% by weight. Noack volatility may be measured according to CEC-L-40-A-93.

The lubricant compositions may have a viscosity at 150° C. and a shear rate of $10^6$ $s^{-1}$ of no greater than 3 cP, such as no greater than 2.8 cP. This high temperature high shear viscosity may be measured according to CEC-L-36-A-90.

The lubricant composition may have at least one of:

an oxidative stability performance on a CEC-L-088-02 test indicated by an absolute viscosity increase at 40° C. of no more than 45 cSt, such as no more than 35 cSt or no more than 25 cSt; a fuel economy performance on a CEC-L-054-96 test of at least 2.5%, such as at least 3%; a piston cleanliness performance on a CEC-L-088-02 test indicated by an overall piston merit of at least 8.5, such as 9; and an oxidative stability performance on a CEC-L-109-14 test indicated by an increase in kinematic viscosity at 100° C. of less than 200%, preferably less than 150%, at 216 hours and/or less than 200%, preferably less than 150%, at 168 hours.

The lubricant compositions may have a cold-crankcase simulator performance at −30° C. of less than about 3000, such as less than about 2800, or less than about 2750, for example as measured according to ASTM D5293.

Preferred lubricant compositions meet the requirements set out in SAE J300.

The lubricant compositions may be used in a method of lubricating a surface.

Suitable surfaces include those in power transmission systems for example drive lines and gear boxes for example for vehicles including for example passenger vehicles and heavy duty vehicles; and those in internal combustion engines, for example the crankcases of internal combustion engines. Suitable surfaces also include those in turbine bearings for example in water turbine bearings.

Suitable internal combustion engines include, for example, engines used in automotive applications, engines used in marine applications and engines used in land-based power generation plants. The lubricant compositions are particularly suited to use in an automotive internal combustion engine.

The lubricant compositions may be used to improve the fuel economy and/or piston cleanliness performance of an internal combustion engine and/or a vehicle, such as an automotive vehicle associated with an internal combustion engine. Accordingly, there are provided methods of improving the fuel economy and/or piston cleanliness performance of an internal combustion engine and/or a vehicle, such as an automotive vehicle associated with an internal combustion engine, comprising the step of providing or supplying to the engine and/or vehicle at least one of the lubricant compositions.

The invention will now be described with reference to the accompanying figure and examples, which are not limiting in nature, in which:

FIG. 1 is a graph of percentage increase in Kinematic Viscosity at 100° C. against time corresponding to results of CEC-L-109 testing of blended compositions containing Guerbet-derived base stock (GE3) and/or a Group III base stock (Yubase 4) together with varying amounts of aminic oxidant and/or phenolic oxidant as well as other lubricant additives.

EXAMPLES

Example 1

Properties of Ether Base Stocks

Guerbet-derived base stock GE3 of formula (1) was prepared, the structure of which is shown in Table 4.

TABLE 4

| | Molecular Weight | Chemical Formula | Structure |
|---|---|---|---|
| GE3 | 522.97 | $C_{36}H_{74}O$ | 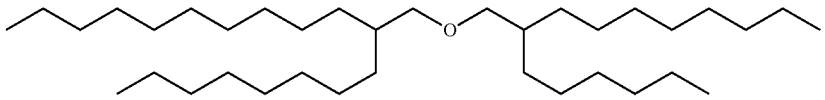 |

The following properties of the base stock were tested:

Kinematic viscosity at 100° C. (KV100) and kinematic viscosity at 40° C. (KV40) were tested according to ASTM D7279.

Viscosity index (VI) was calculated according to ASTM D2270.

Pour point was determined according to ASTM D7346.

Differential scanning calorimetry (DSC) oxidation onset temperature was tested using a method which was based on ASTM E2009 (method B). According to the method, the base stocks were heated from 50° C. to 300° C., at a rate of 50° C./minute, under a pressure of 500 psi in an aluminium SFI pan. The temperature at which an exotherm was observed was recorded.

Noack volatility was measured using a method which was based on IP 393 and was considered similar to CEC-L-40-A-93. According to the method, reference oils of known Noack volatility were heated from 40° C. to 550° C. to determine the temperature at which the Noack volatility weight loss of each of the reference oils was reached. The base stocks were subjected to the same process as the reference oils. The Noack weight of the base stocks could be determined based on the results obtained from the reference oils.

The results of the tests are summarized in Table 5, together with results obtained from a conventional base stock (Yubase 4, a group III base stock).

TABLE 5

| | KV100 (cSt) | KV40 (cSt) | VI | Pour Point (° C.) | DSC Oxidation Onset T (° C.) | Noack volatility (% by weight) |
|---|---|---|---|---|---|---|
| GE3 | 3.9 | 16.0 | 143 | −42 | 202.89 | 2.4 |
| Yubase 4 | 4.2 | 19.2 | 126 | −12 | 220.00 | 11.7 |

It can be seen that the Guerbet-derived base stock ether has a lower volatility, lower pour point and lower kinematic viscosity as compared to the conventional base oil.

Example 2

Properties of Lubricant Compositions Containing Ether Base Stocks

Guerbet-derived ether base stock GE3 was blended with conventional base oil additives (additive A, a commercially available additive package providing a dispersant level representative of high performance engine oil between 7 and 10 wt % based on the total weight of the lubricant composition; additive B, a cold-flow improver; additive C, an oxidation inhibitor; and additive D, a viscosity index improver) and conventional base oils (Yubase 4, a group III base oil; and Yubase 6, a group III base oil) to form a lubricant blend. A Baseline blend was also prepared. Yubase 4 was chosen as the main component of the Baseline blend, since it exhibits a similar KV100 to Guerbet-derived ether base stock, GE3. The Baseline blend was believed to be a stringent baseline for comparison, since it is a 5W-30 formulation which meets certain specifications (ACEA A5/B5, API-SN/GF-4). The details of the blended compositions are shown in Table 6 in % by weight.

TABLE 6

| | Baseline blend | GE3 blend |
|---|---|---|
| Additive A | 16.4 | 16.4 |
| Additive B | 0.15 | 0.15 |
| Additive C | 0.1 | 0.1 |
| Additive D | 4 | 4 |
| Yubase 4 | 67.45 | 17.45 |
| Yubase 6 | 11.9 | 11.9 |
| GE3 | 0 | 50 |

No problems with miscibility were encountered during preparation of the blended compositions.

The blended compositions were tested to see whether the advantageous properties of the base stocks would be reflected in a fully formulated lubricant composition. The following properties were tested:

Kinematic viscosity at 100° C. (KV100) and kinematic viscosity at 40° C. (KV40) were tested according to ASTM D445 (part of SAE J300).

Viscosity index (VI) was calculated according to ASTM D2270.

Cold-cranking simulator (CCS) analysis was carried out at −30° C. according to ASTM D5293 (part of SAE J300).

High temperature high shear (HTHS) analysis was carried out according to CEC-L-36-A-90.

Total base number (TBN) was determined according to ASTM D2896.

Noack volatility was tested according to CEC-L-40-A-93.

Sulphated ash content was measured according to IP 163.

The results of the tests are summarized in Table 7.

TABLE 7

| | Baseline blend | GE3 blend |
|---|---|---|
| KV40 (cSt) | 53.59 | 44.63 |
| KV100 (cSt) | 9.542 | 8.688 |
| VI | 164 | 177 |
| CCS −30° C. (cP) | 4656 | 2702 |
| HTHS (cP) | 2.98 | 2.75 |
| TBN (mg KOH/g) | 11.66 | 11.44 |
| NOACK (% by weight) | 11.2 | 9.7 |
| Sulphated ash (%) | 1.22 | 1.27 |

It can be seen that the properties of the Guerbet-derived base stock are also exhibited in the blended composition. In particular, beneficial viscosity, volatility and cold-flow properties are observed. The Guerbet-derived base stock also exhibited similar HTHS measurements, TBNs and sulphated ash contents to the Baseline blend.

Example 3

CEC-L-85-99 Test

Blended compositions comprising Guerbet-derived base stock (GE3), a group III base stock (Yubase 4) or a group IV base stock (PAO 4) together with varying amounts of aminic oxidant (a diphenylamine) and/or phenolic oxidant (a substituted phenol) were subjected to the CEC-L-85-99 test, which measures DSC oxidation onset temperature, and a method similar to ASTM E2998 B which measures DSC oxidation induction time of the tested blends. Results obtained from the CEC-L-85-99 testing are shown in Table 8 (compositional data shown in % by weight).

TABLE 8

| Blend | A | B | C | D | E | F | G | H | J | K | L | M |
|---|---|---|---|---|---|---|---|---|---|---|---|---|
| Yubase 4 | 100 | 99.5 | 99.5 | 99 | | | | | | | | |
| PAO 4 | | | | | 100 | 99.5 | 99.5 | 99 | | | | |
| GE3 ether | | | | | | | | | 100 | 99.5 | 99.5 | 99 |
| Aminic AO | | | 0.5 | 0.5 | | | 0.5 | 0.5 | | | 0.5 | 0.5 |
| Phenolic AO | | 0.5 | | 0.5 | | 0.5 | | 0.5 | | 0.5 | | 0.5 |
| DSC oxidation onset temperature (° C.) | 221 | 246 | 246 | 254 | 222 | 245 | 249 | 258 | 209 | 236 | 241 | 252 |
| DSC oxidation induction time (mins) | <3.0 | 7.5 | 4.1 | 20.0 | <3.0 | 10.4 | 6.0 | 20.8 | <3.0 | 4.2 | 3.1 | 27.8 |

The results in Table 8 demonstrate that both the oxidation onset temperature and oxidation induction time is increased, indicating increased oxidative stability, in the ether blends when either phenolic anti-oxidant (Blend K) or aminic anti-oxidant (Blend L) are present (compared against Blend J). Additionally, a substantial increase in oxidation onset temperature and oxidation induction time is observed when both aminic and phenolic anti-oxidants are added (Blend M). Notably, when non-ether blends are compared (Blends B to D and F to H) there is clearly only modest increase in oxidation onset temperature and oxidation induction time when both aminic and phenolic anti-oxidants are present (Blends D and H) compared to when they are present singly (Blends B, C, F and G). This indicates that there are synergistic effects associated with the ether base stock with aminic and phenolic anti-oxidants, which are not observed with the non-ether base stocks, or when phenolic and aminic oxidants are present singly. This can be readily seen when comparing the tested blends comprising both aminic and phenolic anti-oxidants present (Blends D, H and M), where moving to the ether based system (Blend M) results in over a 25% increase in oxidation induction time over the group III and IV based systems (Blends D and H).

Example 4

CEC-L-85-99 Test—Fully Formulated Lubricant Compositions

Fully formulated lubricant compositions comprising Guerbet-derived base stock (GE3) and a group III base stock (Yubase 4) together with varying amounts of aminic oxidant and/or phenolic oxidant (low=0.1 wt. %, high=0.5 wt. %), as well as other lubricant additives including (non-borated) dispersant, detergents, viscosity index modifier (VIM) and secondary ZDDP, were subjected to the CEC-L-85-99 test. Results obtained from the CEC-L-85-99 testing are shown in Table 9 (compositional data shown in % by weight).

The results in Table 9 demonstrate that both the oxidation onset temperature and oxidation induction time is increased, indicating increased oxidative stability, when the level of phenolic anti-oxidant and aminic anti-oxidant is increased in the ether based compositions. Additionally, a substantial increase in oxidation onset temperature and oxidation induction time is observed when both aminic and phenolic anti-oxidants are each added at a level of 0.5 wt. % (Compositions 12 and 16) compared to when one of the aminic or phenolic anti-oxidant is present at a lower concentration of 0.1 wt % (Compositions 10, 11, 14 and 15).

TABLE 9

| Lubricant Composition | 1 | 2 | 3 | 4 | 5 | 6 | 7 | 8 | 9 | 10 |
|---|---|---|---|---|---|---|---|---|---|---|
| Yubase 4 | 84.62 | 84.22 | 84.22 | 83.82 | 84.085 | 83.685 | 83.685 | 83.285 | 34.62 | 34.22 |
| GE3 ether | | | | | | | | | 50 | 50 |

TABLE 9-continued

| | | | | | | | | | | |
|---|---|---|---|---|---|---|---|---|---|---|
| Phenolic AO | 0.1 | 0.5 | 0.1 | 0.5 | 0.1 | 0.5 | 0.1 | 0.5 | 0.1 | 0.5 |
| Aminic AO | 0.1 | 0.1 | 0.5 | 0.5 | 0.1 | 0.1 | 0.5 | 0.5 | 0.1 | 0.1 |
| Detergents | 2.18 | 2.18 | 2.18 | 2.18 | 2.18 | 2.18 | 2.18 | 2.18 | 2.18 | 2.18 |
| Dispersant | 6 | 6 | 6 | 6 | 6 | 6 | 6 | 6 | 6 | 6 |
| ZDDP | | | | | 0.535 | 0.535 | 0.535 | 0.535 | | |
| VM | 7 | 7 | 7 | 7 | 7 | 7 | 7 | 7 | 7 | 7 |
| DSC oxidation onset temperature (° C.) | 262 | 261 | 266 | 269 | 267 | 267 | 271 | 266 | 258 | 258 |
| DSC oxidation induction time (mins) | 19.2 | 29.0 | 36.1 | 47.2 | 43.9 | 40.0 | 56.3 | 45.0 | 17.2 | 21.8 |

| Lubricant Composition | 11 | 12 | 13 | 14 | 15 | 16 |
|---|---|---|---|---|---|---|
| Yubase 4 | 34.22 | 33.82 | 34.085 | 33.685 | 33.685 | 33.285 |
| GE3 ether | 50 | 50 | 50 | 50 | 50 | 50 |
| Phenolic AO | 0.1 | 0.5 | 0.1 | 0.5 | 0.1 | 0.5 |
| Aminic AO | 0.5 | 0.5 | 0.1 | 0.1 | 0.5 | 0.5 |
| Detergents | 2.18 | 2.18 | 2.18 | 2.18 | 2.18 | 2.18 |
| Dispersant | 6 | 6 | 6 | 6 | 6 | 6 |
| ZDDP | | | 0.535 | 0.535 | 0.535 | 0.535 |
| VM | 7 | 7 | 7 | 7 | 7 | 7 |
| DSC oxidation onset temperature (° C.) | 262 | 266 | 261 | 259 | 269 | 267 |
| DSC oxidation induction time (mins) | 30.2 | 44.6 | 43.0 | 41.5 | 45.2 | 61.6 |

Notably, the presence of ZDDP, in addition to aminic and phenolic anti-oxidants, also surprisingly confers a substantial increase in oxidative stability as shown by the corresponding increases in oxidation onset temperature and oxidation induction time (Compositions 13 to 16 compared to Compositions 9 to 12). Furthermore, this effect is particularly pronounced where aminic and phenolic antioxidants are present in equal amounts of 0.5 wt. % in the ether-based composition (Composition 16). This pronounced effect is not, however, observed in the corresponding non-ether-based system (Composition 8), indicating that there are synergistic effects associated with the combination of an ether base stock together with aminic and phenolic anti-oxidants and ZDDP. The presence of ZDDP therefore offers a further improvement in oxidative stability in the compositions of the invention whilst also contributing to improved anti-wear performance of the lubricant composition.

Example 5

Rotary Bomb and CEC-L-109 Tests

Fully formulated lubricant compositions comprising Guerbet-derived base stock (GE3) and a group III base stock (Yubase 4) together with varying amounts of aminic oxidant and/or phenolic oxidant, as well as other lubricant additives including (non-borated) dispersant, borated dispersant, detergents, viscosity modifier (VM) and secondary ZDDP, were subjected to the CEC-L-109 tests. The CEC-L-109 test is a high temperature oxidation test designed to determine the oxidative stability of an engine lubricant, via the measurement of percentage increase in Kinematic Viscosity at 100° C. ("KV 100% change"), with lower percentage changes indicative of higher oxidative stability. Results obtained from the CEC-L-109 testing are shown in Table 10 (compositional data shown in % by weight).

TABLE 10

| Lubricant Composition | a | b | c | d | e | f | g | h | i | j |
|---|---|---|---|---|---|---|---|---|---|---|
| Yubase 4 | 84.618 | 83.818 | 84.083 | 83.283 | 82.484 | 32.484 | 82.484 | 32.484 | 82.484 | 32.484 |
| GE3 ether | | | | | | 50 | | 50 | | 50 |
| Phenolic AO | 0.1 | 0.5 | 0.1 | 0.5 | 1 | 1 | 1 | 1 | 1 | 1 |
| Aminic AO | 0.1 | 0.5 | 0.1 | 0.5 | 1 | 1 | 1 | 1 | 1 | 1 |
| Detergents | 2.18 | 2.18 | 2.18 | 2.18 | 2.18 | 2.18 | 2.18 | 2.18 | 1.32 | 1.32 |
| Magnesium containing detergent | | | | | | | | | 0.86 | 0.86 |
| Dispersant | 6 | 6 | 6 | 6 | 6 | 6 | | | 6 | 6 |
| Borated dispersant | | | | | | | 6 | 6 | | |
| ZDDP | | | 0.535 | 0.535 | 0.334 | 0.334 | 0.334 | 0.334 | 0.334 | 0.334 |
| VM | 7 | 7 | 7 | 7 | 7 | 7 | 7 | 7 | 7 | 7 |

TABLE 10-continued

| Lubricant Composition | a | b | c | d | e | f | g | h | i | j |
|---|---|---|---|---|---|---|---|---|---|---|
| Antifoam | 0.002 | 0.002 | 0.002 | 0.002 | 0.002 | 0.002 | 0.002 | 0.002 | 0.002 | 0.002 |
| Average KV100 change (%) | 76.0 | 64.3 | 561 | too viscous to measure | 227 | 40.7 | too viscous to measure | 84.4 | too viscous to measure | 76.1 |

The CEC-L-109 test results, in the form of average percentage increase in Kinematic Viscosity at 100° C., illustrate the benefit of increasing the total antioxidant concentration (compare the result for Composition b with that of Composition a) as well as the negative impact of the presence of ZDDP on oxidative stability of the non-ether based lubricant compositions in this test (compare results for Compositions a and b with those of Compositions c and d).

However, it is apparent from the results for Composition f that the oxidative stability of the ether-based compositions as measured by the CEC-L-109 test is not significantly impacted by the presence of ZDDP, where this is clearly not the case for the corresponding non-ether based Composition e, which has the same levels of ZDDP and antioxidants as Composition f (40.7% change for Composition f versus 227% change for Composition e). These results are indicative of synergy between the ether base stock in the lubricant composition and the ZDDP and antioxidant components. This therefore means that greater amounts of ZDDP can be used with the ether compositions of the invention without significantly impacting upon the oxidative stability of the composition, such that the full anti-wear benefit of ZDDP can be realized.

For lubricant compositions g and h, the presence of 6 wt. % borated dispersant provides approximately 0.021 wt. % of boron (on an elemental basis) to the lubricant compositions. The presence of the borated dispersant and associated boron gives rise to a substantial increase in percentage change in Kinematic Viscosity at 100° C. for the non-ether based Composition g (too viscous to measure). In contrast, the presence of borated dispersant in the ether-based Composition h is well tolerated with only a moderate average percentage increase in Kinematic Viscosity at 100° C. (84.4%). These results demonstrate that oxidative stability of the ether compositions of the invention is substantially maintained despite increases in boron content. This is of particular benefit since an increase in boron in the lubricant composition leads to increased elastomer compatibility and reduced corrosion.

For lubricant compositions i and j, the presence of 0.86 wt. % magnesium-containing detergent provides approximately 0.072 wt. % magnesium (on an elemental basis) to the lubricant compositions. The presence of the magnesium-containing detergent gives rise to a substantial increase in percentage change in Kinematic Viscosity at 100° C. for the non-ether based Composition i (too viscous to measure). In contrast, the presence of magnesium-containing detergent in the ether-based Composition j is well tolerated with only a moderate average percentage increase in Kinematic Viscosity at 100° C. (76.1%). These results demonstrate that oxidative stability of the ether compositions of the invention is substantially maintained despite increases in magnesium content. This is of particular benefit since an increase in magnesium-containing detergents in the lubricant composition provides reduced sulphated ash level for the same total base number (acid neutralisation capability) compared to calcium-containing detergents.

The effect of the presence of ZDDP and/or borated dispersant in compositions of the invention (Compositions f and h) compared to conventional non-ether based compositions (Compositions e and g) as discussed above are also illustrated in FIG. 1.

The results in the above examples demonstrate the benefit of the ether base stocks together with aminic and phenolic antioxidants for improving oxidative stability, as well as the additional benefits resulting from a synergy with ZDDP. These results demonstrate that aminic and phenolic antioxidants can be used in lower amounts in lubricant compositions comprising ether base stocks in accordance with the invention and achieve similar or better oxidative stability in comparison to conventional non-ether based lubricant compositions. A reduction in aminic anti-oxidant in a lubricant composition for an internal combustion engine has a particular benefit in reducing turbocharger deposits as well as a reduction in copper corrosion and an increase in elastomer compatibility. Meanwhile, a reduction in phenolic antioxidant leads to an improvement in environmental toxicity of the lubricant compositions.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope and spirit of this invention.

The invention claimed is:

1. A lubricant composition comprising a base oil, wherein the base oil comprises greater than 50% by weight of an ether base stock of formula (2):

(2)

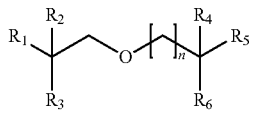

where: $R_1$, $R_2$, $R_4$, and $R_6$ are $C_{1-15}$ alkyl;
$R_3$ and $R_5$ are H or $C_{1-15}$ alkyl; and
n is 1;

the lubricant composition further comprising at least one aminic anti-oxidant and at least one phenolic anti-oxidant;

wherein the at least one phenolic anti-oxidant is selected from alkylated mono-phenols, alkylated hydroquinones, hydroxylated thiodiphenyl ethers, alkylidenebisphenols, acylaminophenols, and sulphurised alkyl phenols and alkali and alkaline earth metal salts thereof; and wherein the at least one aminic anti-oxidant is selected from alkylated and non-alkylated aromatic amines, alkylated diphenylamines, N-alkylated phenylenediamines, phenyl-α-naphthylamine, and alkylated phenyl-α-naphthylamines.

2. The lubricant composition of claim 1, wherein $R_1$, $R_2$, $R_4$, and $R_6$ are straight chain $C_{1-15}$ alkyl, and wherein $R_3$ and $R_5$ are H or straight chain $C_{1-15}$ alkyl.

3. The lubricant composition of claim 1, wherein R1, $R_4$, and $R_6$ are $C_{01-12}$ alkyl, and wherein $R_3$ and $R_5$ are H.

4. The lubricant composition of claim 1, wherein $R_1$, $R_2$, $R_4$, and $R_6$ are $C_{2-10}$ alkyl, and wherein $R_3$ and $R_5$ are H.

5. The lubricant composition of claim 1, wherein $R_1$, $R_2$, $R_4$, and $R_5$ are $C_{4-10}$ alkyl, and wherein $R_3$ and $R_5$ are H.

6. The lubricant composition of claim 1, wherein the ether base stock contains a total number of carbons atoms of from 20 to 50.

7. The lubricant composition of claim 1, wherein the ether base stock is prepared from bio-derived feedstock containing greater than 50% by weight of biobased carbon.

8. The lubricant composition of claim 1, wherein the lubricant composition comprises greater than 80% by weight of the base oil.

9. The lubricant composition of claim 8, wherein the base oil of the lubricant composition further comprises a base stock selected from Group I, Group II, Group III, Group IV and Group V base stocks and mixtures thereof.

10. The lubricant composition of claim 1, wherein the lubricant composition has at least one of:

a kinematic viscosity at 40° C. of less than 60 cSt;

a kinematic viscosity at 100° C. of less than 12 cSt;

a viscosity index of greater than 100;

a viscosity at 150° C. and a shear rate of $10^6$ $s^{-1}$ of no greater than 3 cP; and a Noack volatility of less than 25% by weight.

11. The lubricant composition of claim 1, wherein the lubricant composition has at least one of:

an oxidative stability performance on a CEC-1,088-02 test indicated by an absolute viscosity increase at 40° C. of no more than 45 cSt;

an oxidative stability performance on a CEC-L-109-14 test indicated by an increase in kinematic viscosity at 100° C. of less than 200% at 216 hours and/or an increase in kinematic viscosity at 100° C. of less than 200% at 168 hours.

12. The lubricant composition of claim 1, wherein the weight ratio of aminic anti-oxidant to phenolic anti-oxidant in the lubricant composition is from 2:1 to 1:2.

13. The lubricant composition of claim 1, wherein the total combined amount of aminic and phenolic anti-oxidant in the lubricant composition is not more than 1.0% by weight of the lubricant composition.

14. The lubricant composition of claim 1, wherein the total combined amount of aminic and phenolic anti-oxidant in the lubricant composition is at least 0.5% by weight of the lubricant composition.

15. The lubricant composition of claim 1, wherein a total amount of any non-aminic and non-phenolic antioxidant in the lubricant composition is not more than 1.0% by weight of the lubricant composition.

16. The lubricant composition of claim 1, wherein the at least one phenolic anti-oxidant is selected from 2-t-butyl-4-heptyl phenol, 2-t-butyl-4-octyl phenol, 2-t-butyl-4-dodecyl phenol, 2,6-di-t-butyl-4-methylphenol, 2,6-di-t-butyl-4-heptylphenol, 2,6-di-t-butyl-4-dodecylphenol, 2-methyl-6-t-butyl-4-heptylphenol, 2-methyl-6-t-butyl-4-dodecylphenol, 4,4'-methylenebis(2,6-di-t-butylphenol), 2'-bis(4-heptyl-6-t-butylphenol), 2,2'-bis(4-octyl-6-t-butylphenol), 2,2'-bis(4-dodecyl-6-t-butylphenol), 4, 4'-bis(2,6-di-t-butylphenol), 4,4'-methylene-bis(2,6-di-t-butylphenol) and derivatives thereof.

17. The lubricant composition of claim 1, wherein the at least one aminic anti-oxidant is selected from p,p-dioctylphenylamine, t-octylphenyl-α-naphthylamine, p-octylphenyl-α-naphthylamine, monooctyldiphenylamine, N,N-di(2-naphthyl)-p-phenylenediamine, phenyl-1-naphthylamine, phenyl-2-naphthylamine, an alkylphenyl-1-naphthylamine, an alkylphenyl-2-naphthylamine and derivatives thereof.

18. The lubricant composition of claim 1, wherein the amount of phosphorus contained in the lubricant composition is less than 0.5 wt. % based on the total weight of the lubricant composition.

19. The lubricant composition of claim 1, wherein the amount of boron contained in the lubricant composition is from 0.005 wt. % to 0.05 wt. %.

20. The lubricant composition of claim 1, wherein the lubricant composition comprises one or more dihydrocarbyl dithiophosphate metal salts in an amount of from 0.01 wt. % to 10.0 wt. %.

21. A method of preparing a lubricant composition, said method comprising providing a base oil as defined in claim 1 and blending the base oil with at least one aminic anti-oxidant and at least one phenolic anti-oxidant, and optionally one or more additional lubricant additives in order to prepare the lubricant composition.

* * * * *